US008684348B2

(12) United States Patent
Matsuyama et al.

(10) Patent No.: US 8,684,348 B2
(45) **Date of Patent: *Apr. 1, 2014**

(54) SHEET SUPPLYING DEVICE AND IMAGE FORMING APPARATUS INCORPORATING SAME

(71) Applicant: Toshio Matsuyama, Tokyo (JP)

(72) Inventors: Yasuo Matsuyama, Hyogo (JP); Ippei Kimura, Osaka (JP); Takamitsu Ikematsu, Osaka (JP); Ikuo Fujii, Osaka (JP); Kaoru Tada, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/738,370

(22) Filed: Jan. 10, 2013

(65) Prior Publication Data

US 2013/0200562 A1 Aug. 8, 2013

(51) Int. Cl.
*B65H 1/22* (2006.01)

(52) U.S. Cl.
USPC ..... 271/164; 271/145

(58) Field of Classification Search
USPC ..... 271/145, 162, 164; 399/393
See application file for complete search history.

(56) References Cited

U.S. PATENT DOCUMENTS

| | | | | |
|---|---|---|---|---|
| 5,666,595 | A * | 9/1997 | Sameshima et al. | 399/110 |
| 8,360,418 | B2 * | 1/2013 | Matsuyama et al. | 271/162 |
| 2012/0061907 | A1 | 3/2012 | Matsuyama et al. | |
| 2012/0063829 | A1 | 3/2012 | Matsuyama et al. | |

FOREIGN PATENT DOCUMENTS

| | | | | |
|---|---|---|---|---|
| JP | 4-246030 | | 9/1992 | |
| JP | 04272035 | A * | 9/1992 | B65H 1/26 |
| JP | 5-000740 | | 1/1993 | |
| JP | 9-221236 | | 8/1997 | |
| JP | 2001-310825 | | 11/2001 | |
| JP | 2005-255363 | | 9/2005 | |
| JP | 2005-280980 | | 10/2005 | |
| JP | 2007-106545 | | 4/2007 | |
| JP | 2008-285264 | | 11/2008 | |

* cited by examiner

*Primary Examiner* — Jeremy R Severson
(74) *Attorney, Agent, or Firm* — Harness, Dickey & Pierce, P.L.C.

(57) ABSTRACT

A sheet supplying device includes a recording media container to accommodate a stack of recording media therein, a sheet feeding unit to feed a recording medium from the stack of recording media in the recording media container, a frame to support the recording media container and the sheet feeding unit, a holder to hold the recording media container by surrounding the outer circumference of the recording media container, and a locking mechanism to engage the frame and the holder with each other. The recording media container is detachably attachable to the frame in a first detaching and attaching operation and a second detaching and attaching operation. The locking mechanism causes the frame and the holder to engage at removal of the recording media container in the first detaching and attaching operation.

11 Claims, 14 Drawing Sheets

SHEET SUPPLYING DEVICE AND IMAGE FORMING APPARATUS INCORPORATING SAME

CROSS-REFERENCE TO RELATED APPLICATION

This patent application is based on and claims priority pursuant to 35 U.S.C. §119 to Japanese Patent Application No. 2012-010860, filed on Jan. 23, 2012, in the Japan Patent Office, the entire disclosure of which is hereby incorporated by reference herein.

BACKGROUND OF THE INVENTION

1. Field of the Invention

Embodiments of the present invention relate to a sheet supplying device that supplies a sheet-like recording medium to an image forming unit, and an image forming apparatus such as a laser printer, digital copier, facsimile machine and so forth, incorporating the sheet supplying device.

2. Description of the Related Art

Sheet supplying devices that can be incorporated in an image forming apparatus include a sheet supply tray or sheet supply cassette detachably attachable to the image forming apparatus that can accommodate an accumulated stack of recording media. The sheet supply tray is generally pulled out and inserted into the image forming apparatus through an opening formed in one side of the frame. That is, the sheet supply tray can be detachably attached in one direction only.

However, when an image forming apparatus is installed, some installation areas may have an obstacle or obstacles on the side to which the opening is provided. Therefore, in some recent approaches, a single sheet supply tray is configured to be detachably attachable to the image forming apparatus from two directions, as disclosed in Japanese Patent Application Publication Nos. 2005-255363 (JP-2005-255363-A) and H09-221236 (JP-H09-221236-A), for example. According to this configuration, even if the sheet supply tray cannot be pulled out and inserted into the image forming apparatus from one direction, sheets or recording media accommodated in the sheet supply tray can be set from another direction.

Typically, in a configuration in which the sheet supply tray is detachably attachable to the image forming apparatus from two directions, the sheet supply tray can be slidably moved in a direction along a sheet conveyance direction and a direction perpendicular to the sheet conveyance direction. In this case, a guide mechanism is required at a position between the sheet supply tray and the frame of the image forming apparatus (the sheet containing side) to guide the sheet supply tray as it is detached from and attached to the image forming apparatus. Therefore, the frame may need to include one guide rail for guiding the sheet supply tray in the sheet conveyance direction and another guide rail for guiding the sheet supply tray in the direction perpendicular to the sheet conveyance direction.

Further, two different positioning mechanisms such as a stopper or the like for positioning the sheet supply tray when inserted in the image forming apparatus are required: One positioning mechanism for detaching and attaching the sheet supply tray in the sheet conveyance direction and another positioning mechanism for detaching and attaching the sheet supply tray in the direction perpendicular to the sheet conveyance direction.

In short, to enable detachment and attachment of the sheet supply tray with respect to the frame of the image forming apparatus in those two directions, guide rails, stoppers and other components or units for two directions may need to be provided to the frame of the image forming apparatus. This can make the configuration of the frame complicated and is not likely to make it more compact. Further, when the sheet supply tray is inserted into or removed from the image forming apparatus in one direction, the movement can be hindered by components such as a guide rail and a positioning stopper provided for movement in the other direction. Therefore, movement in both directions cannot be performed stably or reliably.

SUMMARY OF THE INVENTION

The present invention describes a novel sheet supplying device including a recording media container to accommodate a stack of recording media therein, a sheet feeding unit to feed a recording medium from the stack of recording media in the recording media container, a frame to support the recording media container and the sheet feeding unit, a holder to hold the recording media container by surrounding the outer circumference of the recording media container, and a locking mechanism to engage the frame and the holder with each other. The recording media container is detachably attachable to the frame in a first detaching and attaching operation in which the recording media container is inserted into or removed from the frame in a direction parallel to a sheet conveyance direction in which the recording medium is fed and conveyed upstream or downstream by the sheet feeding unit, and the recording media container is separated from the frame and the holder with the holder remaining in the frame, and a second detaching and attaching operation in which the recording media container is inserted into or removed from the frame in a direction perpendicular to the sheet conveyance direction, and the recording media container is separated from the frame together with the holder. The locking mechanism engages the frame and the holder at the removal of the recording media container in the first detaching and attaching operation.

In response to the unlocking of the locking mechanism, the recording media container installed in the frame may be removed from the frame during either one of the first detaching and attaching operation and the second detaching and attaching operation.

The locking mechanism may include a locking portion and a locking claw. The locking claw is engaged with the locking portion in a state in which the recording media container may be separated from the frame during the first detaching and attaching operation. The locking claw may be disengaged from the locking portion in a state in which the recording media container is installed in the frame.

The locking claw of the locking mechanism may be mounted together with the frame on a frame installed side.

The locking claw of the locking mechanism may be mounted apart from the frame on a frame installed side. The locking claw may be switched between a locked state and an unlocked state by moving slidably.

The locking claw of the locking mechanism may be mounted apart from the frame on a frame installed side. The locking claw may be switched between a locked state and an unlocked state by swinging.

The locking mechanism may include a recessed portion and a locking claw. The locking claw may be engaged with the recessed portion in a state in which the recording media container is separated from the frame during the first detaching and attaching operation. The locking claw may be disengaged from the recessed portion in a state in which the recording media container is installed in the frame.

The locking claw of the locking mechanism may be mounted together with the frame on a frame installed side.

The locking claw of the locking mechanism may be mounted apart from the frame on a frame installed side. The locking claw may be switched between a locked state and an unlocked state by moving slidably.

The locking claw of the locking mechanism may be mounted apart from the frame on a frame installed side. The locking claw may be switched between a locked state and an unlocked state by swinging.

Further, the present invention describes a novel image forming apparatus including the above-described sheet supplying device.

Further, the present invention describes a novel image forming apparatus corresponding to one of a copier, printer, printing machine, inkjet printer, facsimile machine, and multifunctional system including at least two functions of the copier, printer, printing machine, inkjet printer, and facsimile machine. The above-described image forming apparatus includes the above-described sheet supplying device, an image forming device to form an image on the recording medium fed from the sheet feeding device, and a sheet discharging device to discharge the recording medium with the image formed thereon.

BRIEF DESCRIPTION OF THE DRAWINGS

A more complete appreciation of the invention and many of the advantages thereof will be obtained as the same becomes better understood by reference to the following detailed description when considered in connection with the accompanying drawings, wherein.

DETAILED DESCRIPTION OF THE INVENTION

Figure 1:
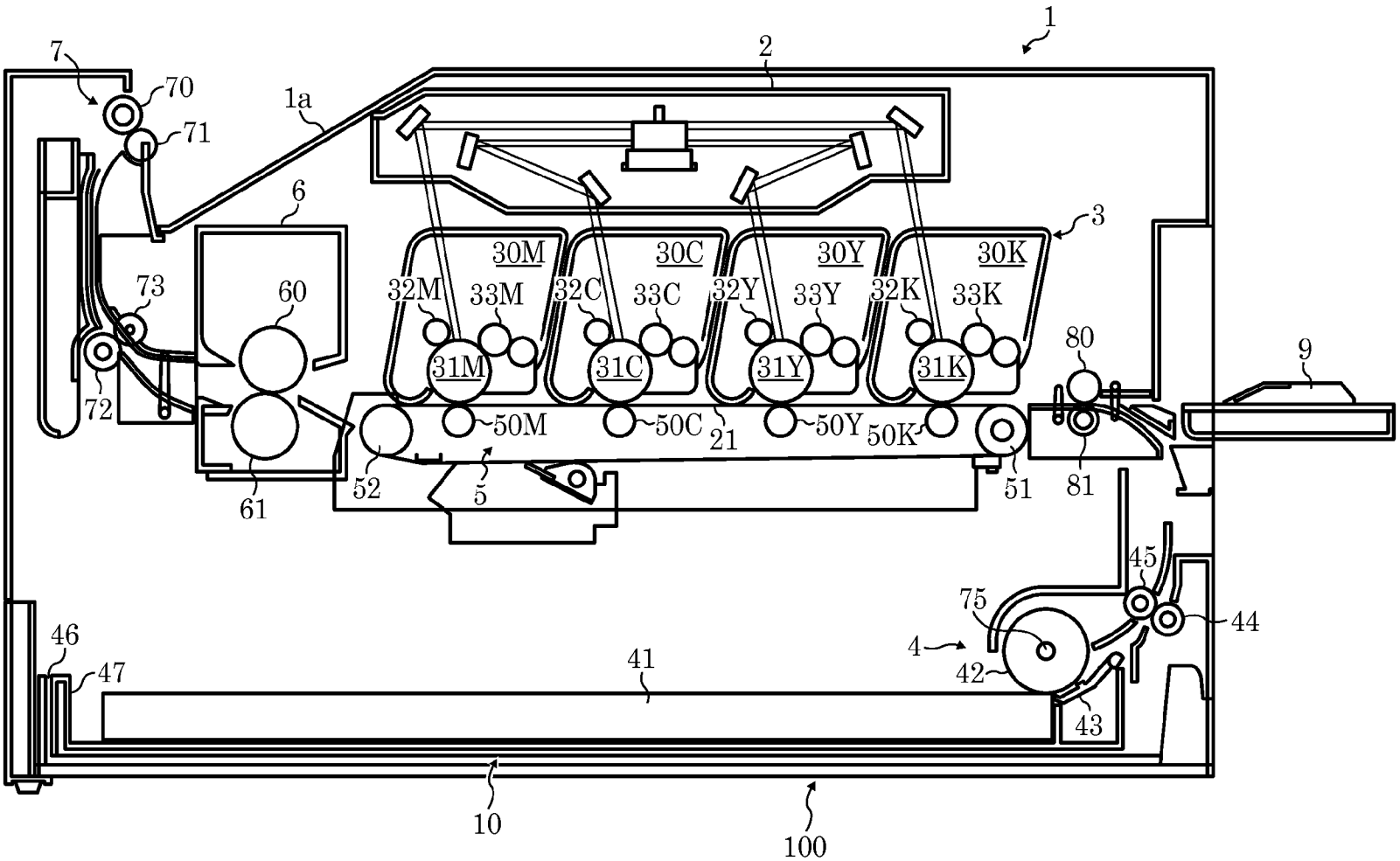
FIG. 1 is a cross-sectional view illustrating an overall configuration of an image forming apparatus employing a sheet feeding device.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification or variation of exemplary embodiments, etc., of an image forming apparatus according to the present invention. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present invention.

The present invention is applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that have the same function, operate in a similar manner, and achieve a similar result.

Referring now to the drawings, wherein like reference numerals designate identical or corresponding parts throughout the several views, preferred embodiments of the present invention are described.

Embodiment

FIG. 1 is a cross-sectional view illustrating an overall configuration of an image forming apparatus 1 employing a sheet feeding device 100 according to an embodiment of the present invention.

The image forming apparatus 1 according to an embodiment of the present invention is a color image forming apparatus employing an image forming mechanism performing an electrophotographic process to form color images using a general electrostatic image forming method. However, the present invention is not limited to this configuration. Further, the image forming mechanism is applicable for black-and-white printing, inkjet printing and so forth.

The image forming apparatus 1 includes an image forming device 3 disposed at the upper portion thereof for forming an image and the sheet feeding device 100 disposed at the lower portion thereof, specifically below the image forming device 3, for supplying recording media to the image forming device 3.

The sheet feeding device 100 includes a recording media container 47, a sheet feeding unit 4, and a frame 10.

The frame 10 holds the recording media container 47 and the sheet feeding unit 4.

The recording media container 47 accommodates a stack of recording media 41 therein. Details of the recording media container 47 will be described below.

The sheet feeding unit 4 contacts the stack of recording media 41 stored in the recording media container 47 from above to feed a recording medium from the stack of recording media 41. The stack of recording media 41 is a bundle of multiple sheet-like recording media accumulated one after another.

The sheet feeding unit 4 includes a rotary shaft 75 and a sheet feeding roller 42. As the rotary shaft 75 of the sheet feeding roller 42 rotates, a recording medium placed on top of the stack of recording media 41 stored in the recording media container 47 is fed therefrom by the sheet feeding roller 42 and a separation pad 43 that serves as a sheet separation member disposed facing the sheet feeding roller 42. The recording medium thus fed from the recording media container 47 is then conveyed by vertical conveying rollers 44 and 45 toward a registration roller 81. Then, the leading edge of the recording medium abuts against a nip contact area formed between the registration roller 81 and the registration tension roller 80 to align the leading edge of the recording medium. The registration roller 81 rotates to synchronize with movement of the recording medium to match the transfer position of the toner image and the recording medium.

The image forming device 3 includes a transfer belt unit 5 and four image forming units 30M, 30C, 30Y, and 30K. The transfer belt unit 5 is disposed to extend in a horizontal direction in the image forming apparatus 1. The four image forming units 30M, 30C, 30Y, and 30K are disposed horizontally above the transfer belt unit 5 along the upper portion of an endless transfer belt 21 to develop and form an image in each of the image forming units 30M, 30C, 30Y, and 30K, which serve as an image carrier.

The elements or components of the image forming units 30M, 30C, 30Y, and 30K are similar in structure and functions to each other, except that the image forming units 30M, 30C, 30Y, and 30K have different colors of toner, and therefore are also referred to as the image forming unit 30 in a singular form. For example, the image forming unit 30 (i.e., the image forming units 30M, 30C, 30Y, and 30K) includes a photoconductor drum 31 (i.e., photoconductor drums 31M, 31C, 31Y, and 31K), and image components are disposed around an outer circumferential surface of the photoconductor drum 31. The image components are, for example, a charging roller 32 (i.e., charging rollers 32M, 32C, 32Y, and 32K) for uniformly charging a surface of the photoconductor drum 31, a developing roller 33 (i.e., developing rollers 33M, 33C, 33Y, and 33K) for developing an electrostatic latent image formed on the surface of the photoconductor drum 31 into a visible toner image, a transfer roller 50 (i.e., transfer rollers 50M, 50C, 50Y, and 50K) for transferring the toner image onto a recording medium, and a cleaning unit (not illustrated here) for cleaning the photoconductor drum 31 after transfer of the toner image onto the recording medium by removing residual toner from the surface of the photoconductor drum 31.

An optical writing unit 2 that serves as a light exposing unit is disposed above the image forming units 30M, 30C, 30Y, and 30K so as to emit laser light beams L toward the photoconductor drums 31.

The transfer belt unit 5 includes the endless transfer belt 21, a drive roller 52, and a driven roller 51. The transfer belt 21 is wound around the drive roller 52 and the driven roller 51.

The transfer rollers 50M, 50C, 50Y, and 50K are disposed in contact with the inner loop of the upper portion of the transfer belt 21 in a horizontal manner and facing the photoconductor drums 31M, 31C, 31Y, and 31K, respectively, with the transfer belt 21 interposed therebetween, so as to apply transfer bias to the transfer rollers 50M, 50C, 50Y, and 50K.

As the recording medium passes through the transfer belt unit 5 as described above, the image is transferred onto the recording medium. The recording medium having the image thereon is then conveyed to a fixing unit 6 to fix the image to the recording medium there.

The fixing unit 6 includes a fixing roller 60 that serves as a fixing member to fix the toner image to the recording medium and a pressure roller 61 disposed facing the fixing roller 60. Further, a heater (not illustrated here) which serves as a heating member is disposed inside the fixing roller 60. The pressure roller 61 contacts the fixing roller 60 at a predetermined pressure to form a fixing nip contact area.

The recording medium to which the image is fixed in the fixing unit 6 is conveyed to a sheet discharging device 7 and is then discharged with the printed surface down to a sheet discharging portion la that is formed at the upper portion of the image forming apparatus 1. The sheet discharging device 7 includes sheet conveyance rollers 72 and 73 and sheet discharging rollers 70 and 71. Further, the image forming apparatus 1 also includes a manual feed sheet tray 9 to feed recording media from outside.

Next, a description is given of the sheet supplying device 100.

Figure 2:
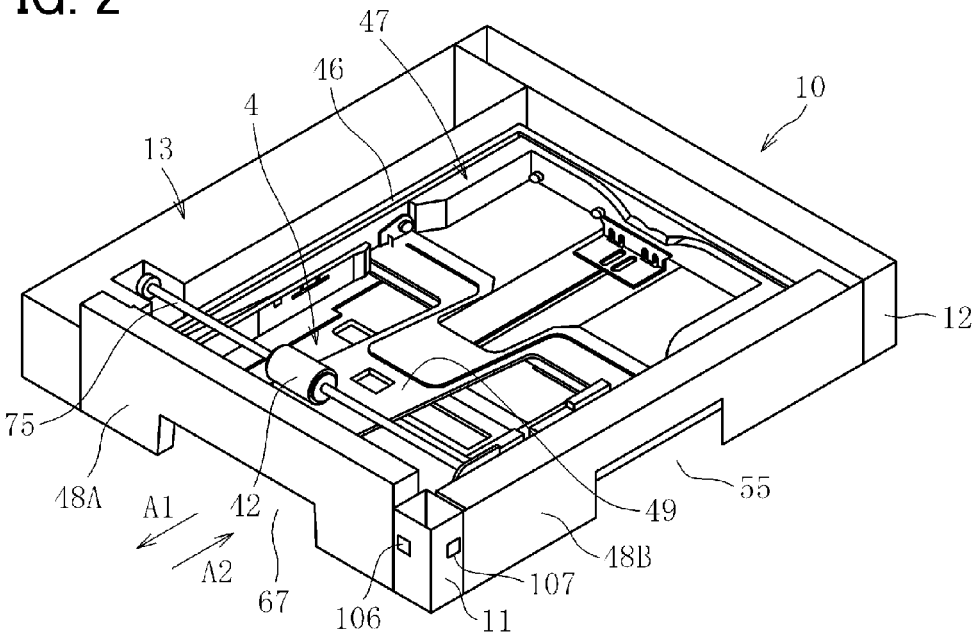
FIG. 2 is a perspective view illustrating the sheet feeding device.
Figure 3:
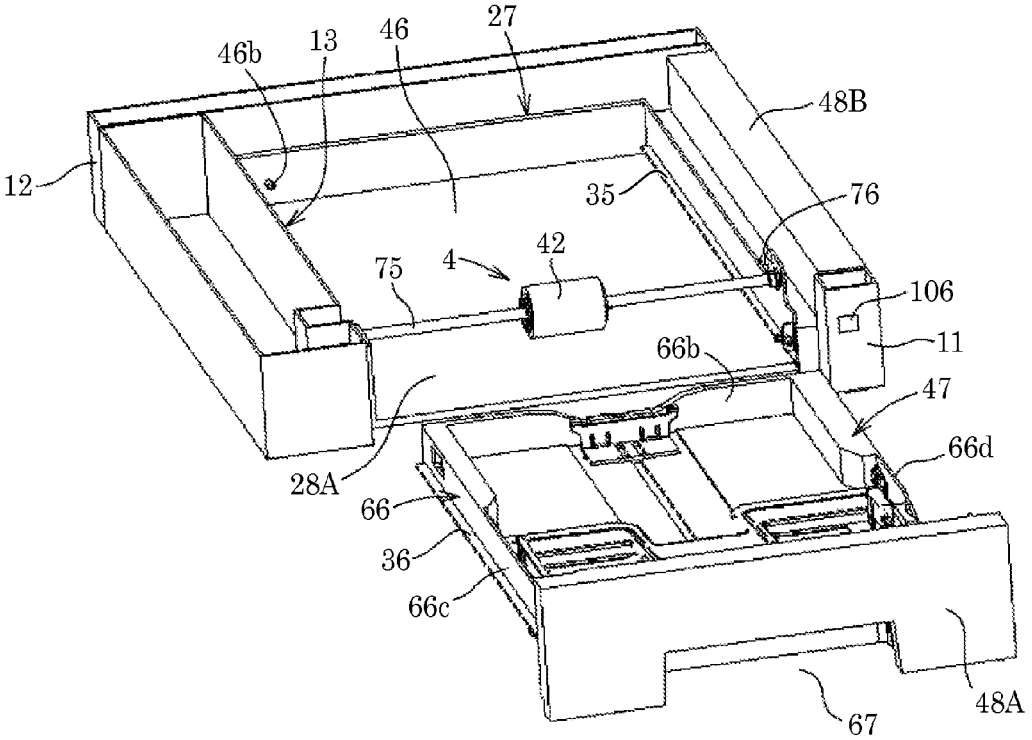
FIG. 3 is a perspective view illustrating the sheet feeding device with a recording media container detached along a sheet conveyance direction.

As previously described, the sheet supplying device 100 includes the recording media container 47, the sheet feeding unit 4, and the frame 10 that includes the recording media container 47 and the sheet feeding unit 4, as illustrated in FIGS. 2 and 3. FIG. 2 illustrates a configuration of the sheet supplying device 100, and FIG. 3 illustrates the configuration of the sheet supplying device 100 with the recording media container 47 removed therefrom. When the recording media container 47 is accommodated in the frame 10 of the sheet supplying device 100, the recording media container 47 is mounted on a holder 46.

With this configuration as illustrated in FIGS. 2 and 3, the recording media container 47 can be withdrawn from and inserted into the frame 10 in a first direction and a second direction. The first direction that corresponds to a sheet conveyance direction in which a recording medium is fed by the sheet feeding unit 4 upstream and/or downstream, which is referred to as a first detaching and attaching operation. The second direction corresponds to a direction perpendicular to the first direction, which is referred to as a second detaching and attaching operation. Specifically, a direction to pull out the recording media container 47 from the frame 10 of the sheet supplying device 100 in the first detaching and attaching operation is indicated by arrow A1 in FIG. 2 and a direction to push the recording media container 47 into the frame 10 of the sheet supplying device 100 (to store the recording media container 47 therein) in the first detaching and attaching operation is indicated by arrow A2 in FIG. 2. Also, a direction to pull out the recording media container 47 from the frame 10 of the sheet supplying device 100 in the second detaching and attaching operation is indicated by arrow B1 in FIGS. 8B and 8C and a direction to push the recording media container 47 into the frame 10 of the sheet supplying device 100 (to store the recording media container 47 therein) in the second detaching and attaching operation is indicated by arrow B2 in FIGS. 8B and 8C.

Figure 4:
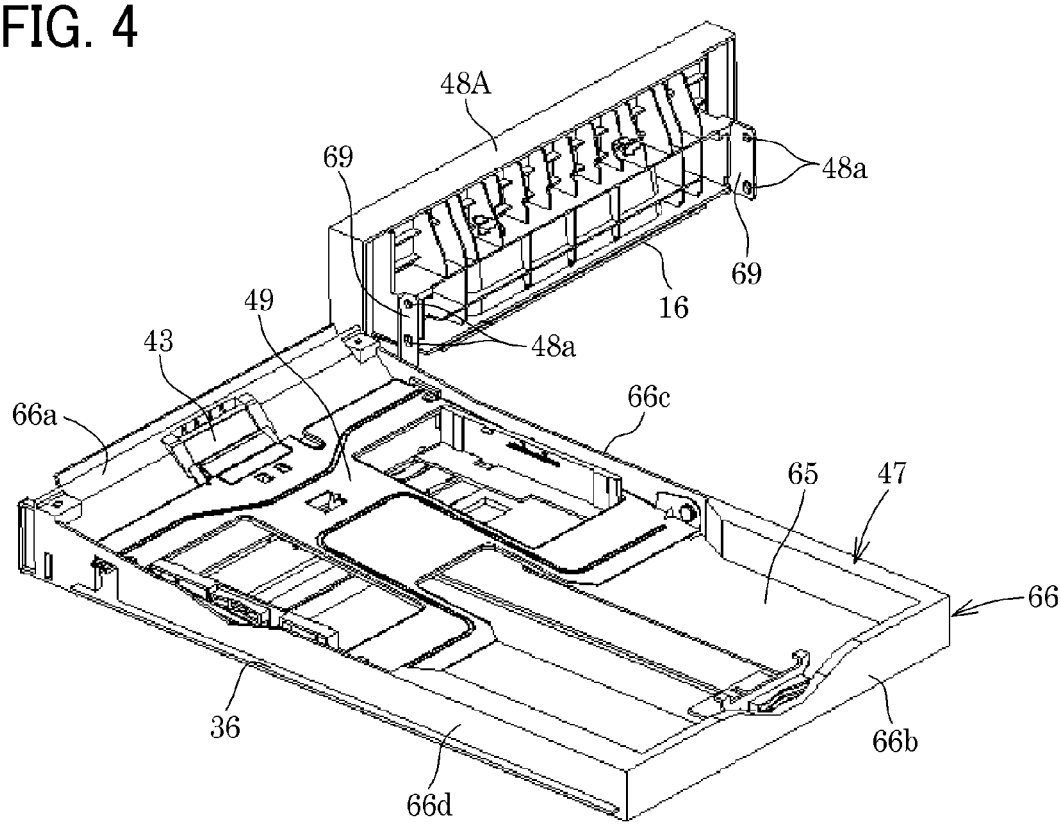
FIG. 4 is a perspective view illustrating the recording media container and a first exterior member.
Figure 5:
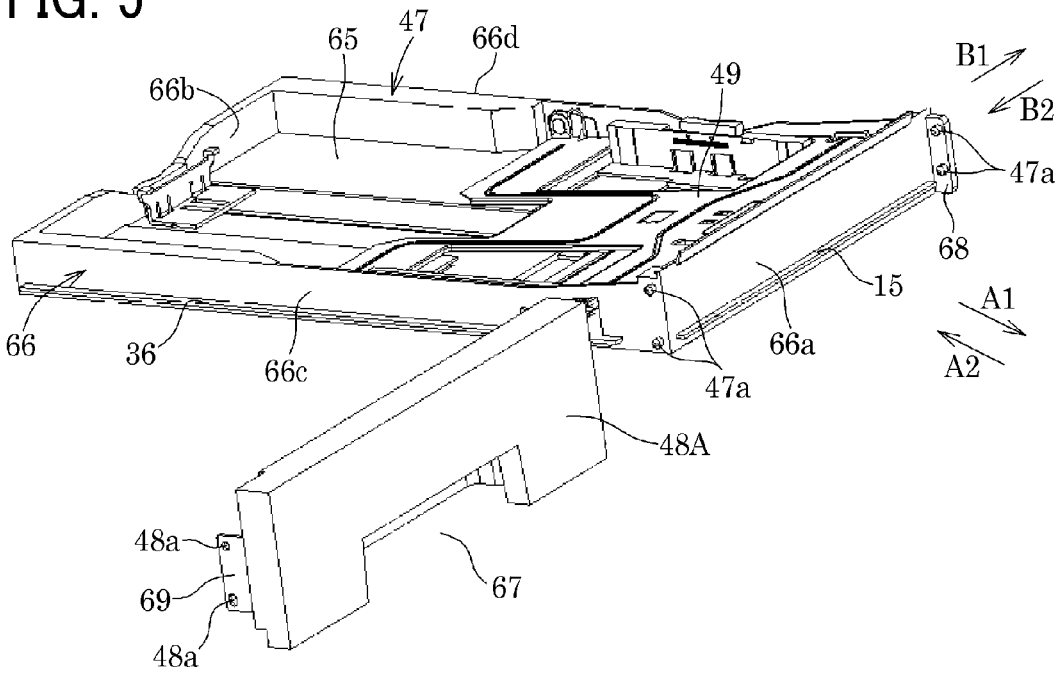
FIG. 5 is a perspective view illustrating the recording media container and the first exterior member, viewed from a different angle of FIG. 4.

As illustrated in FIGS. 4 and 5, the recording media container 47 includes a floor 65 and a peripheral wall assembly 66 along an outer circumference of the floor 65. The peripheral wall assembly 66 includes a front wall 66*a*, a rear wall 66*b*, and a pair of opposed side walls 66*c* and 66*d*, spaced apart from each other. The floor 65 includes a bottom plate 49 to lift up a downstream side of the stack of recording media 41 accommodated in the recording media container 47.

The front wall 66*a* includes a first exterior member (exterior plate) 48A, in a lower center portion of which a handle 67 is provided for pulling the drawer out. The first exterior member 48A is mounted on the front wall 66*a* via a container side engaging member formed on the recording media container 47 and an exterior side engaging member formed on the first exterior member 48A. In this embodiment, the container side engaging member means multiple pin members 47*a* and the exterior side engaging member means respective engaging holes 48*a* that are removably engaged with the pin members 47*a*.

Specifically, one pair of pin members 47*a* is formed vertically on the side wall 66*c* of the recording media container 47 in the vicinity of one end of the front wall 66*a* and another pair of pin members 47*a* is formed vertically on a projecting piece 68 that projects from the side wall 66*d* in the vicinity of the other end of the front wall 66*a* of the recording media container 47. In this case, each pin member 47*a* projects in the direction B2 as shown in FIG. 5.

Further, spaced tabs 69 are disposed at both lateral ends of a back side of the first exterior member 48A, and each of the tabs 69 has a pair of engaging holes 48*a* formed therein. In this case, the pin members 47*a* mounted on the side wall 66*c* and the pin members 47*a* mounted on the side wall 66*d* are displaced in the sheet conveyance direction.

Accordingly, as the first exterior member 48A slidably moves along the front wall 66*a* of the recording media container 47 toward the recording media container 47 in the direction B1 as illustrated in FIG. 5, the pin members 47*a* can engage the respective engaging holes 48*a*. By so doing, whenever the first exterior member 48A is pulled in the direction A1 or pushed in the direction A2, the recording media container 47 moves together with the first exterior member 48A. That is, in movement of the recording media container 47 in the first detaching and attaching operation via the first exterior member 48A (movement using the handle 67 of the first exterior member 48A), the first exterior member 48A and the recording media container 47 can be removed or inserted together in the first detaching and attaching operation.

Meanwhile, with the first exterior member 48A attached to the recording media container 47 as illustrated in FIGS. 2, 3, 6, and 7, when the recording media container 47 is pulled from the first exterior member 48A in the direction B 1, the first exterior member 48A and the recording media container 47 are separated as illustrated in FIGS. 4 and 5.

To separate the first exterior member 48A and the recording media container 47 smoothly, the recording media container 47 has a guide rails 15 at the lower part of the outer surface of the front wall 66*a* and the first exterior member 48A has a guide rail guide 16 to receive the guide rails 15, as illustrated in FIGS. 4 and 5. Namely, with the recording media container 47 contained in the frame 10 of the sheet supplying device 100, as illustrated in FIG. 2, and the guide rails 15 of the recording media container 47 held on the guide rail guide 16 of the first exterior member 48A, if the recording media container 47 is pulled or removed in the direction B1 in the second detaching and attaching operation, the guide rails 15 slidably moves on the guide rail guide 16 to separate the first exterior member 48A.

By contrast, with the recording media container 47 separated from the first exterior member 48A and the guide rails 15 placed on the guide rail guide 16, if the recording media container 47 is inserted into the first exterior member 48A in the direction B2, the guide rails 15 slidably moves on the guide rail guide 16 to attach the recording media container 47 to the first exterior member 48A.

Figure 6:
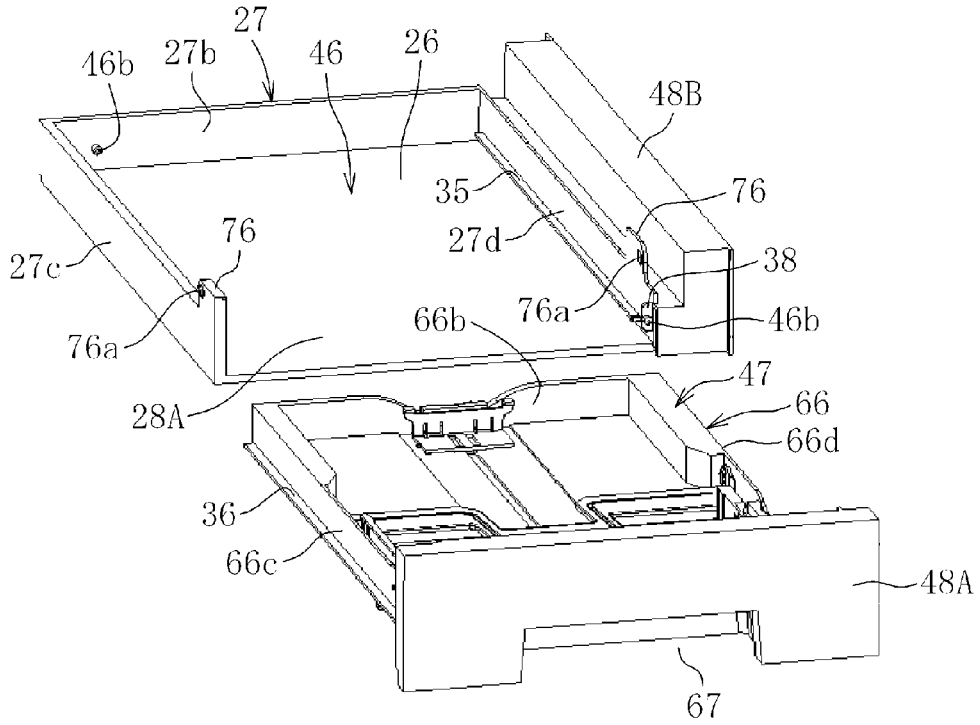
FIG. 6 is a perspective view illustrating the recording media container and a retaining member.

As illustrated in FIG. 6, the holder 46 to hold the recording media container 47 includes a floor 26 and a peripheral wall assembly 27 along an outer circumference of the floor 26. The peripheral wall assembly 27 includes a rear wall 27*b*, and a pair of side walls 27*c* and 27*d* spaced from each other, and one side with no wall formed functions as an opening 28A of the recording media container 47.

As illustrated in FIG. 6, the holder 46 has respective guide rails 35 at the lower part of the outer surface of the side wall 27*c* and 27*d*, and the recording media container 47 has respective guide rail guides 36 to receive the guide rails 35. In this structure, the distance between the inner sides of the spaced side walls 27*c* and 27*d* is made slightly greater than the distance between the outer sides of the spaced side walls 66*c* and 66*d*.

Specifically, with the recording media container 47 separated from the holder 46, as illustrated in FIG. 6, if the guide rail guides 36 of the recording media container 47 are placed on the guide rails 35 of the holder 46 to push the recording media container 47 with respect to the holder 46 in the direction A2, the guide rail guides 36 slidably move on the guide rails 35 to attach the recording media container 47 to the holder 46 to be held by the holder 46.

By contrast, with the recording media container 47 held by the holder 46, if the recording media container 47 is pulled from the holder 46 in the direction A1, the guide rail guides 36 slidably move on the guide rails 35 to detach the recording media container 47 from the holder 46 via the opening 28A.

The holder 46 includes a second exterior member (exterior plate) 48B on the outer side of the side wall 27*d*, and a handle 55 (see FIG. 2) is mounted on the lower center of the front side of the second exterior member 48B.

Figure 7:
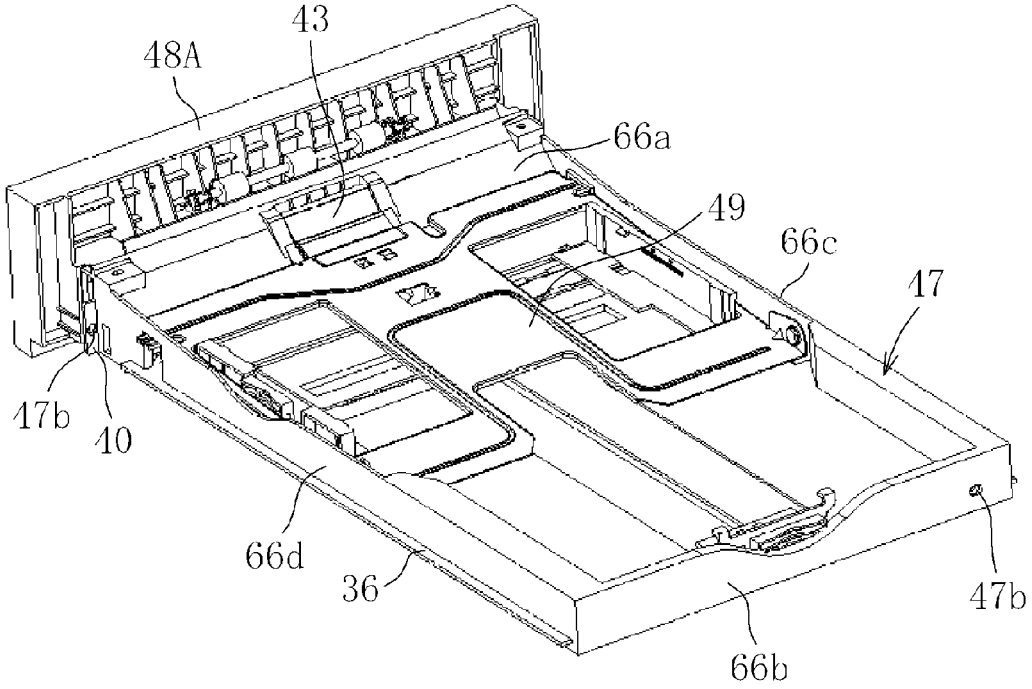
FIG. 7 is a perspective view illustrating the recording media container viewed from the rear side thereof.

The holder 46 includes a holder side locking member as illustrated in FIG. 6 and the recording media container 47 includes a container side container side locking member as illustrated in FIG. 7. In this embodiment, the holder side locking member corresponds to multiple engaging pin members 46*b* and the container side locking member corresponds to respective engaging holes 47*b* that are removably engaged with the engaging pin members 46*b*.

As illustrated in FIG. 6, one of the engaging pin members 46*b* is mounted on the rear wall 27*b* in the vicinity of the side wall 27*c* and the other is formed on a pin piece 38 that is mounted on the side wall 27*d* in the vicinity of the end of the opening 28A.

As illustrated in FIG. 7, one of the engaging holes 47*b* is formed on the rear wall 66*b* in the vicinity of the side wall 66*c* and the other is formed in an outwardly projecting tab 40 mounted on the side wall 66*d* of the recording media container 47 in the vicinity of the front wall 66*a*.

With this configuration, when the recording media container 47 is inserted into the holder 46 via the opening 28A to be held by the holder 46, the engaging pin members 46*b* of the holder 46 are engaged with the respective engaging holes 47*b* of the recording media container 47.

With the engaging pin members 46*b* engaged with the engaging holes 47*b*, when a user uses the handle 67 of the first exterior member 48A to pull the recording media container 47 from the holder 46 in the direction A1, the recording media container 47 can be detached from the holder 46 via the opening 28A. By contrast, with the recording media container 47 separated from the holder 46, when a user uses the handle 67 of the first exterior member 48A to push the recording media container 47 to the holder 46 in the direction A2, the recording media container 47 can be stored in the holder 46 via the opening 28A.

On the other hand, with the recording media container 47 held by the holder 46, the engaging pin members 46*b* of the holder 46 are engaged with the engaging holes 47*b* of the recording media container 47, and therefore the holder 46 and the recording media container 47 can be moved together in a stable manner to be inserted into or removed from the frame 10 of the sheet supplying device 100 in the directions B1 and B2 in the second detaching and attaching operation.

As previously described, the sheet feeding roller 42 of the sheet feeding unit 4 includes the rotary shaft 75 that is pivotably supported at the upper portion of the opening 28A of the holder 46. Namely, as illustrated in FIG. 6, vertical pieces 76 are formed on the side walls 27*c* and 27*d* at both ends of the opening 28A, and include respective pivot holes 76*a* formed thereon, so that both ends of the rotary shaft 75 can be rotatably inserted into the pivot holes 76*a*. Therefore, the rotary shaft 75 is disposed along the directions B1 and B2.

Figure 8A:
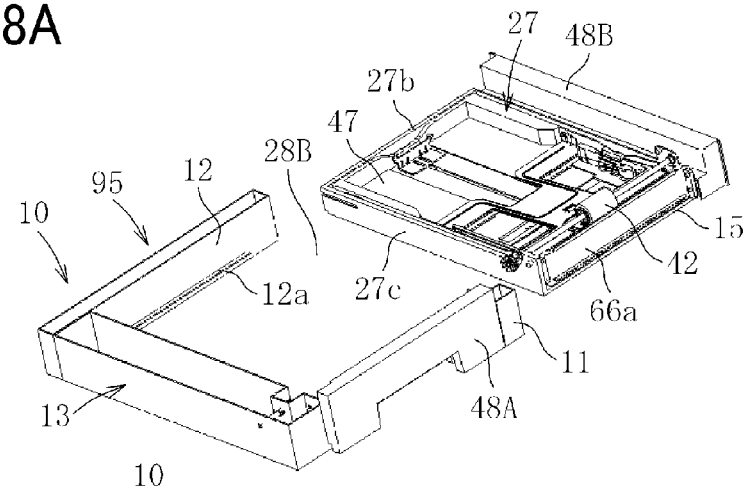
FIGS. 8A through 8C are perspective views illustrating the sheet feeding device in a state in which the recording media container is detached along a direction perpendicular to the sheet conveyance direction.
Figure 8B:
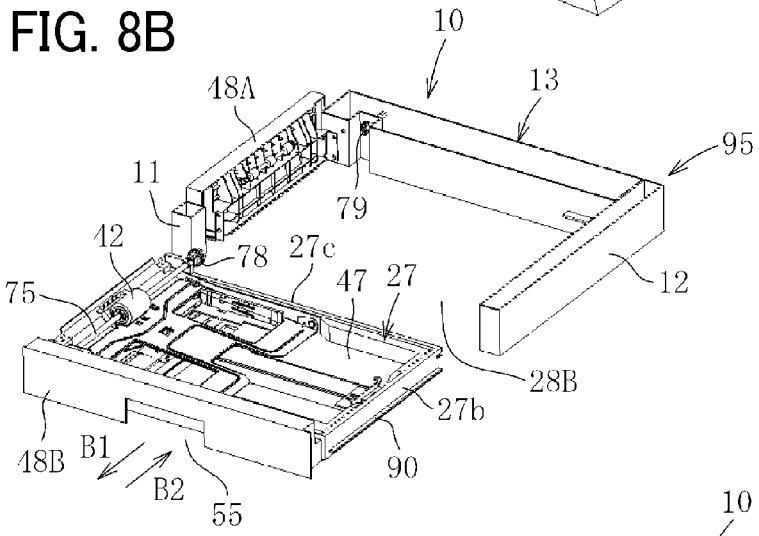

As illustrated in FIG. 8B, a gear member 78 is disposed at one end of the rotary shaft 75, which is opposite the other end in the vicinity of the second exterior member 48B and is connected to a rotary drive force transmission unit (e.g., a coupling) 79 provided on the frame 10 of the sheet supplying device 100. In this case, the gear member 78 is detachably attachable to the rotary drive force transmission unit 79 with the movement of the recording media container 47 in the second detaching and attaching operation.

Figure 8C:
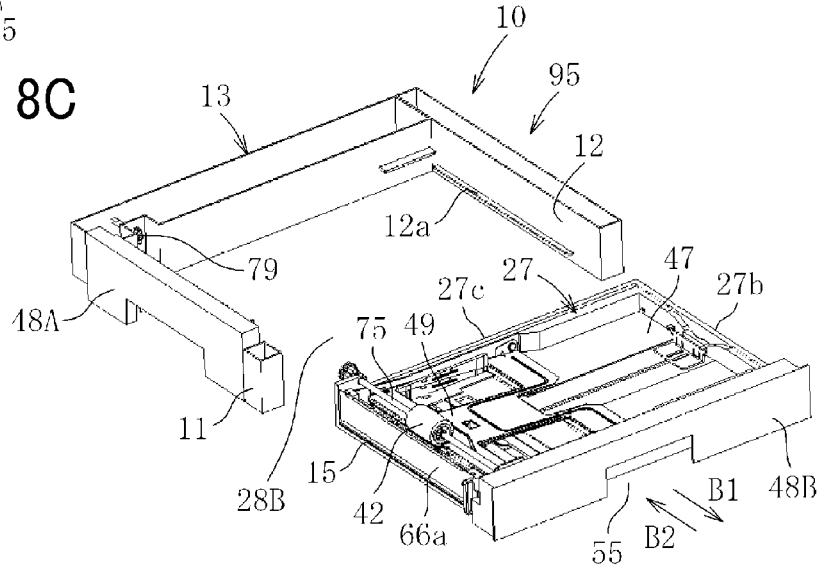

Further, as illustrated in FIGS. 8A through 8C, the frame 10 of the sheet supplying device 100 includes a frame assembly 95 including a front post 11, a rear frame 12, and a side frame 13. The rear frame 12 includes a guide rail 12*a* formed at the lower part of the inner surface thereof. Further, as illustrated in FIG. 8B, the rear wall 27*b* of the holder 46 includes a guide rail 90 formed at the lower part of the outer surface thereof.

In a case in which the recording media container 47 held by the holder 46 is collected in the frame 10, with the first exterior member 48A provided to the frame 10 and the opposite side of the side frame 13 being open, forming an opening 28B as illustrated in FIGS. 8A through 8C, the guide rail 15 of the recording media container 47 is put on the guide rail guide 16 of the first exterior member 48A and the guide rail 90 of the rear wall 27*b* of the holder 46 is put on the guide rail 12*a* of the rear frame 12.

With this configuration, if a user holds the handle 55 of the second exterior member 48B to insert the recording media container 47 held by the holder 46 into the frame 10 in the direction B2, the guide rail 15 slidably moves on the guide rail guide 16 and the guide rail 90 slidably moves on the guide rail 12*a*, and therefore the recording media container 47 held by the holder 46 can be attached to the frame 10 via the opening 28B reliably.

By contrast, if a user holds the handle 55 of the second exterior member 48B to pull out the recording media container 47 held by the holder 46 from the frame 10 in the direction B1, the guide rail 15 slidably moves on the guide rail guide 16 and the guide rail 90 slidably moves on the guide rail 12*a*, and therefore the recording media container 47 held by the holder 46 can be removed from to the frame 10 via the opening 28B reliably.

Figure 9:
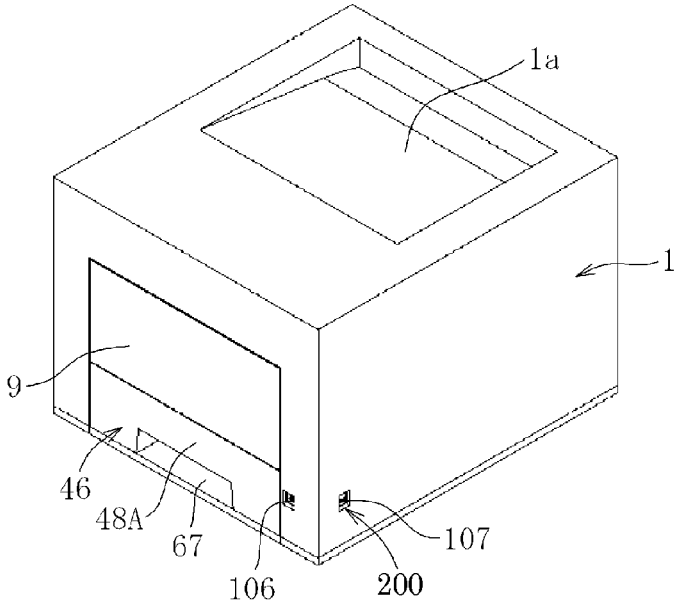
FIG. 9 is a perspective view illustrating an overall simplified appearance of the image forming apparatus.
Figure 10A:
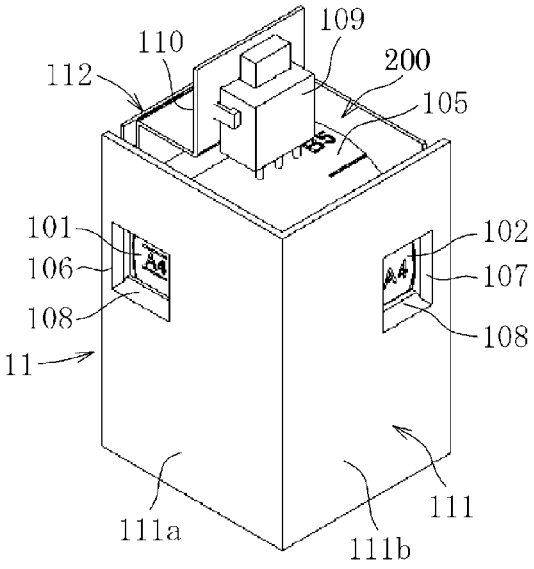
FIG. 10A is a perspective view illustrating an indicating unit disposed at a front post of a main body of the sheet feeding device and FIG. 10B is a perspective view illustrating the indicating unit disposed with a part thereof being removed.
Figure 10B:
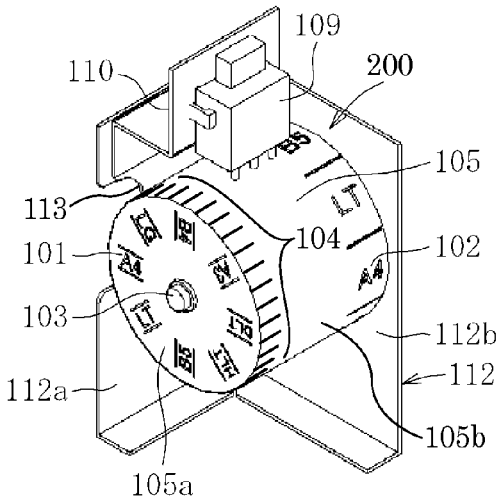

As illustrated in FIG. 9, the image forming apparatus 1 further includes a paper size indicator 200 to check the size of recording media contained in the recording media container 47 when the recording media container 47 is pulled out or inserted into the frame 10 in each of the directions B1 and B2. As illustrated in FIGS. 10A and 10B, the paper size indicator 200 includes a first indication part 101 and a second indication part 102. The first indication part 101 is visible from a direction along the sheet conveyance direction of the recording medium conveyed by the sheet feeding unit 4 and the second indication part 102 is visible from a direction perpendicular to the sheet conveyance direction.

The paper size indicator 200 further includes a rotary drum 105 that is rotatable about a shaft 103. The shaft 103 is disposed parallel to the sheet conveyance direction and is rotatably supported by the front post 11.

The first indication part 101 is arranged on one side surface 105*a* of the rotary drum 105, which is a downward and proximal side surface when pulling the recording media container 47 in the direction A1 in the first detaching and attaching operation, and the sizes of applicable recording media (i.e., the paper sizes) are indicated on the side surface 105*a* along the edge thereof. For example, the paper sizes indicated on the side surface 105*a* in FIGS. 10A and 10B are A3, A4, B4, B5, LG, LT, HCT, and DLT.

The second indication part 102 is arranged on another side surface 105*b*, which is a cylindrical outer surface of the rotary drum 105, and the sizes of applicable recording media or the paper sizes are indicated the side surface 105*b* along an outer circumference thereof. Similarly, the paper sizes indicated on the side surface 105*a* in FIGS. 10A and 10B are A3, A4, B4, B5, LG, LT, HCT, and DLT.

The paper sizes indicated on the first indication part 101 and the second indication part 102 can be observed from the outside of the image forming apparatus 1 through windows 106 and 107, respectively. The windows 106 and 107 are provided on the front post 11. The front post 11 includes a conjoined pair of walls 111 and a conjoined pair of walls 112, each having an L shape in cross-section and combined to form a substantially square tube. The conjoined pair of walls 111 is thicker than the conjoined pair of walls 112.

Specifically, the first window 106 provided for the first indication part 101 is formed in a wall (i.e., on a first wall 111*a* of the conjoined pair of walls 111 illustrated in FIGS. 9 and 10A), which is disposed on a downstream and proximal side of the front post 11 in the sheet conveyance direction in the first detaching and attaching operation, and the second window 107 provided for the second indication part 102 is formed in a different wall (i.e., on a second wall 111*b* of the conjoined pair of walls 111 illustrated in FIGS. 9 and 10A), which is disposed on a downstream and proximal side of the front post 11 in the sheet conveyance direction in the second detaching and attaching operation. Each of the windows 106 and 107 is a through-hole having a rectangular shape or a substantially rectangular shape and includes a slope 108 widening toward an outer end of the through-hole.

The paper size indicator 200 further includes a sensor 109 and embossed portions (not illustrated here). The sensor is disposed above the rotary drum 105 for detecting the size of the recording media. The sensor 109 is a through-beam sensor mounted on the front post 11 and supported by a sensor board 110. The embossed portions are provided on the side surface 105*b* of the rotary drum 105 to indicate each paper size corresponding to the size indicated in the second indication part 102.

The sensor 109 detects the embossed portions, thereby transmitting the paper side indicated by the paper size indicator 200 to the image forming apparatus 1. With this operation, the image forming apparatus 1 determines the paper size.

The indications on the first indication part 101 and the second indication part 102 are switched by a user or an operator by inserting the fingers through the windows 106 and 107, respectively, and turning the rotary drum 105. To facilitate this operation, the image forming apparatus 1 further includes an operation window 113 and an operation dial 104 as illustrated in FIG. 10B. The operation window 113 is an opening in a wall (i.e., a first wall 112*a* of the conjoined pair of walls 112 illustrated in FIG. 10B). The operation dial 104 is a group of convex or concave lines such as notches provided over the outer surface 105*b* of the rotary drum 105 on the side of the side surface 105*a*. In this case, the paper size of the operation dial 104 indicated through the operation window 113 is the same as the paper sizes of the first and second indication parts 101 and 102 indicated through the first window 106 and the second window 107.

The conjoined pair of walls 112 further includes a second wall 112*b* that is disposed opposite to the first wall 111*a* of the conjoined pair of walls 111 and adjacent to the second wall 111*b* of the conjoined pair of walls 111 and the first wall 112*a* of the conjoined pair of walls 112.

With this configuration, the rotary drum 105 can be rotated about the shaft 103 via the operation window 113 as illustrated in FIGS. 10A and 10B. The operation window 113 is provided on the inner side of the opening 28A, the rotary drum 105 can be rotated when the recording media container 47 is pulled out from the frame 10 during the first detaching and attaching operation, as shown in FIG. 3. Providing the operation window 113 facilitates changing the indication of the paper size. In addition, the same size indicated by using the operation dial 104 can be shown via the first window 106 and the second window 107.

After the recording media container 47 is pulled out from the frame 10 during the first detaching and attaching operation and is reloaded with the recording media, the recording media container 47 is ready to be installed in the frame 10 again in the first detaching and attaching operation. At this time, if the holder 46 is removed from the frame 10, the recording media container 47 cannot be set in the first detaching and attaching operation. Therefore, in the state in which the recording media container 47 is detached from the frame 10 in the first detaching and attaching operation as illustrated in FIG. 3, it is preferable that the user or the operator controls the operation such that movement of the holder 46 is restricted and cannot achieved in the second detaching and attaching operation. To enable the restriction of movement of the holder 46, the sheet feeding device 100 of the image forming apparatus 1 according to an embodiment of the present invention further includes a locking mechanism 120 to restrict withdrawal of the holder 46 in the second direction when the recording media container 47 is removed in the first detaching and attaching operation.

A detailed description of the locking mechanism 120 is given with reference to FIGS. 11 through 17.

The locking mechanism 120 includes a locking portion 121 and a locking claw 122. The locking portion 121 is mounted on an outer surface 124 of the rear wall 27*b* of the peripheral wall assembly 27 provided to the holder 46. The locking claw 122 is mounted on the inner wall 123 of the rear frame 12 of the frame 10.

Figure 13:
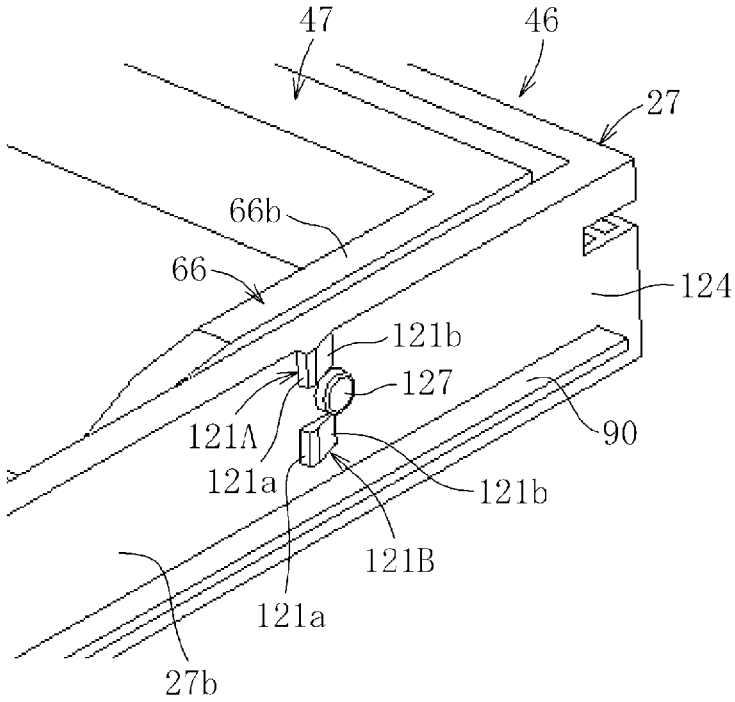
FIG. 13 is a perspective view illustrating a protruding portion of the locking mechanism of FIG. 11.

As illustrated in FIG. 13, the locking portion 121 includes an upper locking part 121A and a lower locking part 121B. Each of the upper locking part 121A and the lower locking part 121B has a substantially isosceles triangle shape in plan view, and includes an end surface 121*a* and a tapered surface 121*b*. The end surface 121*a* extends in the first direction.

Figure 14:
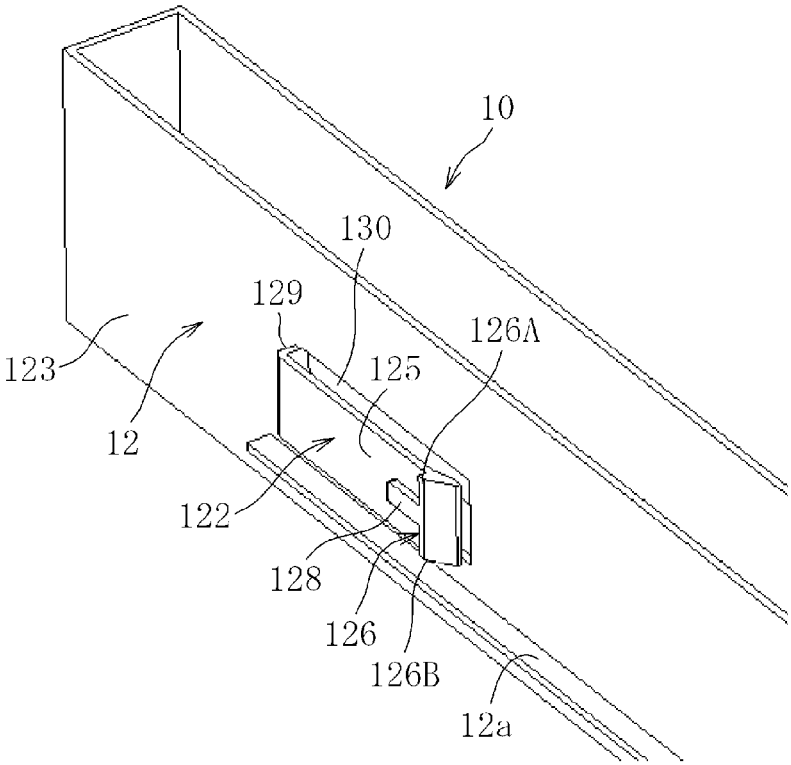
FIG. 14 is a perspective view illustrating a locking claw of the locking mechanism shown in FIG. 11.

As illustrated in FIG. 14, the locking claw 122 includes a swing piece 125, a locking projection 126, and a press tab 128.

The swing piece 125 has a substantially rectangular shape. The locking projection 126 is provided at the leading edge of the swing piece 125 and includes an upper locking projection part 126A and a lower locking projection part 126B. The upper locking projection part 126A and the lower locking projection part 126B are detachably attachable to the upper locking part 121A and the lower locking part 121B, respectively. The press tab 128 is pressed by a pressure rod 127 as described below.

As illustrated in FIG. 14, a vertical piece 129 is formed on the inner wall 123 and the swing piece 125 is connected to the vertical piece 129. Further, an opening 130 having a substantially rectangular shape is provided, facing the swing piece 125, in the inner wall 123 of the rear frame 12. According to this configuration, the swing piece 125 swings or rotates about the vertical piece 129 in directions indicated by arrows C1 and C2 in FIG. 12.

The press tab 128 is a substantially rectangular plate that extends from a substantially middle point in the vertical direction of the locking projection 126 toward the vertical piece 129 to divide the locking projection 126 into the upper locking projection part 126A and the lower locking projection part 126B.

Figure 17:
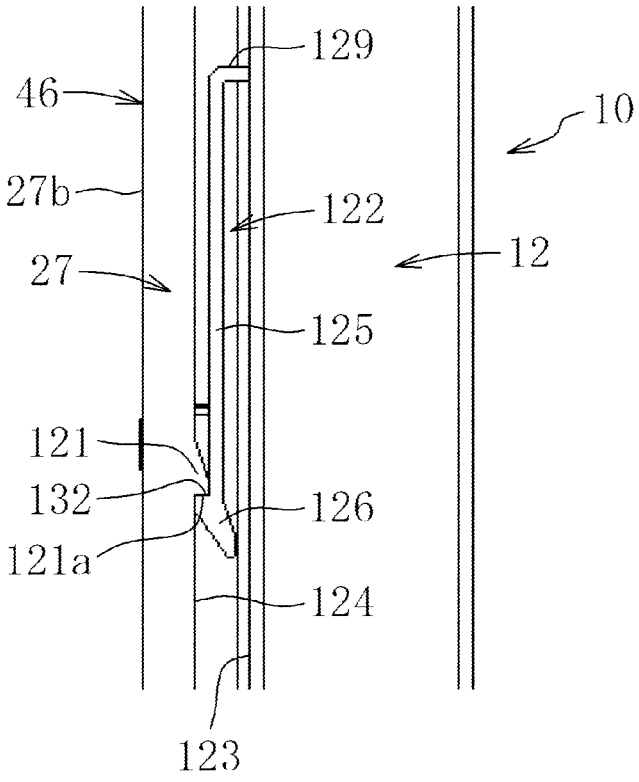
FIG. 17 is a plan view of the locking mechanism of FIG. 11 in the locked state.
Figure 18:
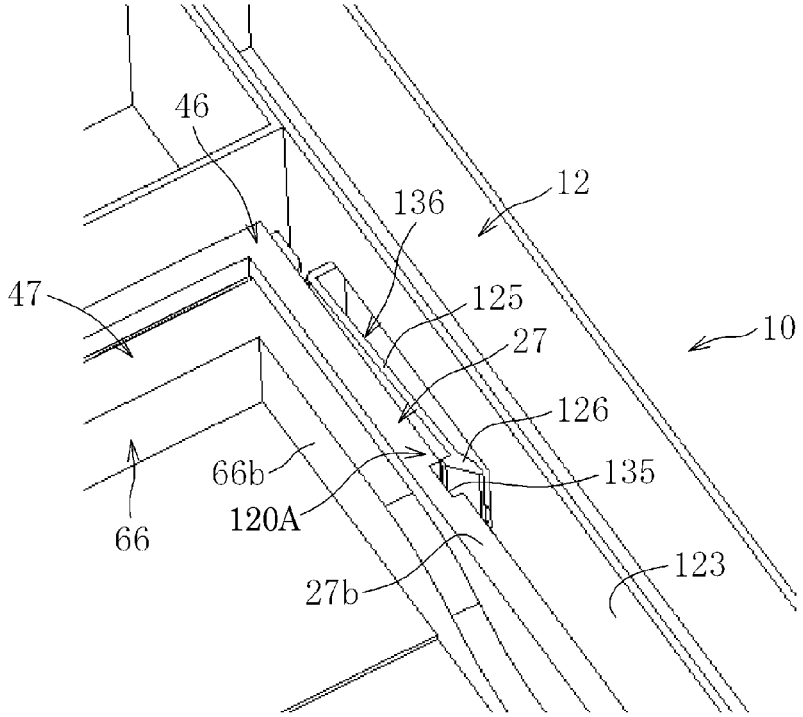
FIG. 18 is a perspective view illustrating a configuration of a locking mechanism according to a first variation.
Figure 19:
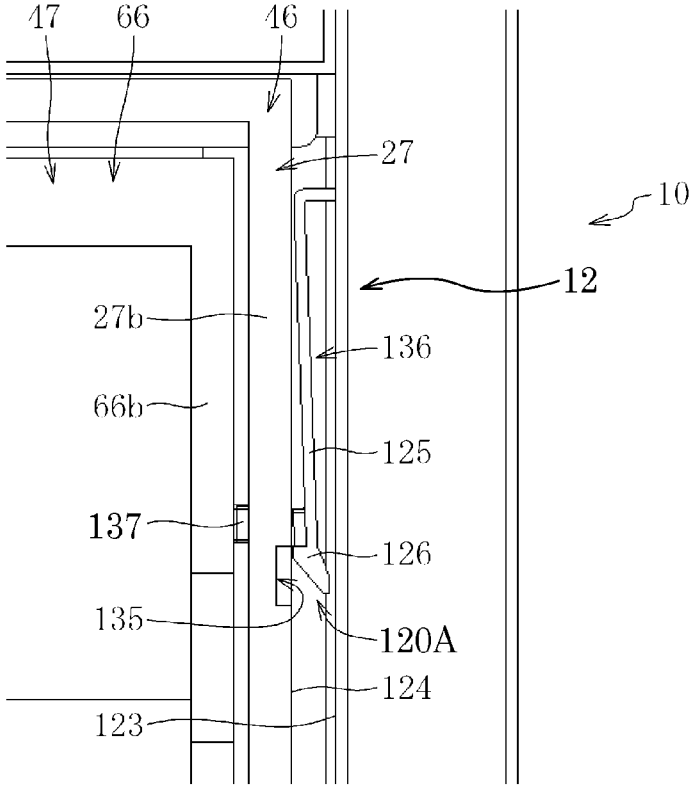
FIG. 19 is a plan view illustrating the locking mechanism of FIG. 18.

As illustrated in FIG. 17, the locking projection 126 further includes an end surface 132 disposed closely facing the end surface 121*a* of the upper and lower locking parts 121A and 121B to stop movement of the holder 46.

Figure 15:
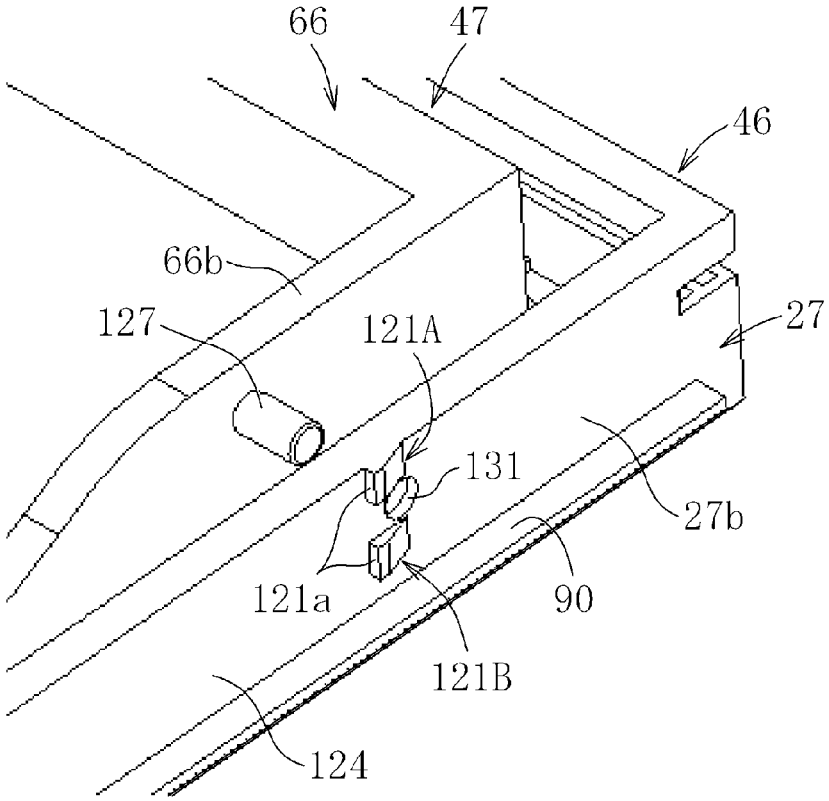
FIG. 15 is a perspective view illustrating the locking mechanism of FIG. 11, in a state in which the recording media container is detached from the exterior member.

As illustrated in FIG. 15, the pressure rod 127 is mounted on the rear wall 66*b* of the peripheral wall assembly 66 of the recording media container 47 and extends in the first direction. The pressure rod 127 is inserted into a through-hole 131 in the rear wall 27*b* of the peripheral wall assembly 27 of the holder 46 while the recording media container 47 is set on the holder 46 that is inserted in the frame 10. That is, as illustrated in FIG. 13, the leading edge of the pressure rod 127 penetrates the through-hole 131 from the outer surface 124 of the rear wall 27*b* and becomes projected on the rear frame 12 of the frame 10. This action causes the leading edge of the pressure rod 127 to press the press tab 128 of the locking claw 122. In this state, the locking claw 122 remains disengaged with the locking portion 121, as illustrated in FIGS. 11 and 12, which is referred to as a "disengaged state".

Figure 11:
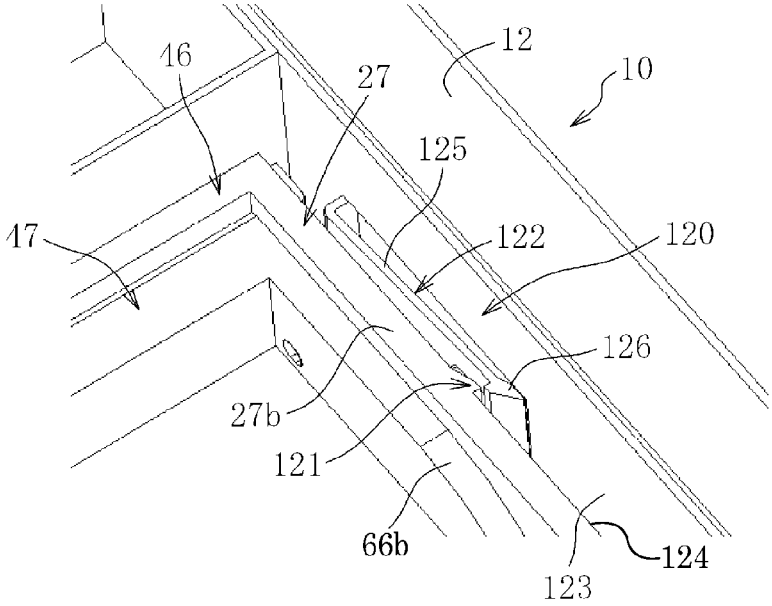
FIG. 11 is a perspective view illustrating a locking mechanism in an unlocked state.
Figure 12:
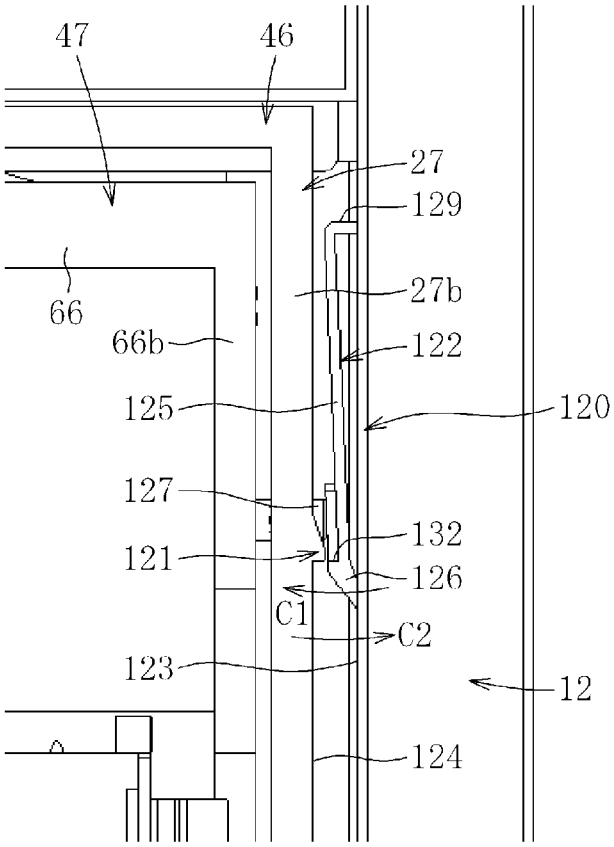
FIG. 12 is a plan view illustrating the locking mechanism of FIG. 11.

In the disengaged state as illustrated in FIGS. 11 and 12, the pressure rod 127 on the side of the recording media container 47 is inserted in the through-hole 131 of the holder 46. Therefore, by holding and pulling the handle 55 of the second exterior member 48B in the direction B1 (see FIGS. 8B and 8C), the holder 46 and the recording media container 47 can be removed together during the second detaching and attaching operation. Further, while the recording media container 47 is stored in the frame 10, the recording media container 47 can be attached to or detached from the image forming apparatus 1 during the second detaching and attaching operation.

Further, under the disengaged state as illustrated in FIGS. 11 and 12, by holding and pulling the handle 67 of the first exterior member 48A in the direction A1 (see FIG. 2), the recording media container 47 can be removed and separated from the holder 46 during the second detaching and attaching operation. Therefore, by pulling out the recording media container 47 in the first detaching and attaching operation, the pressure rod 127 is pulled out from the through-hole 131, as illustrated in FIG. 15, and therefore the pressure rod 127 stops pressing and releases the press tab 128 of the locking claw 122.

Figure 16:
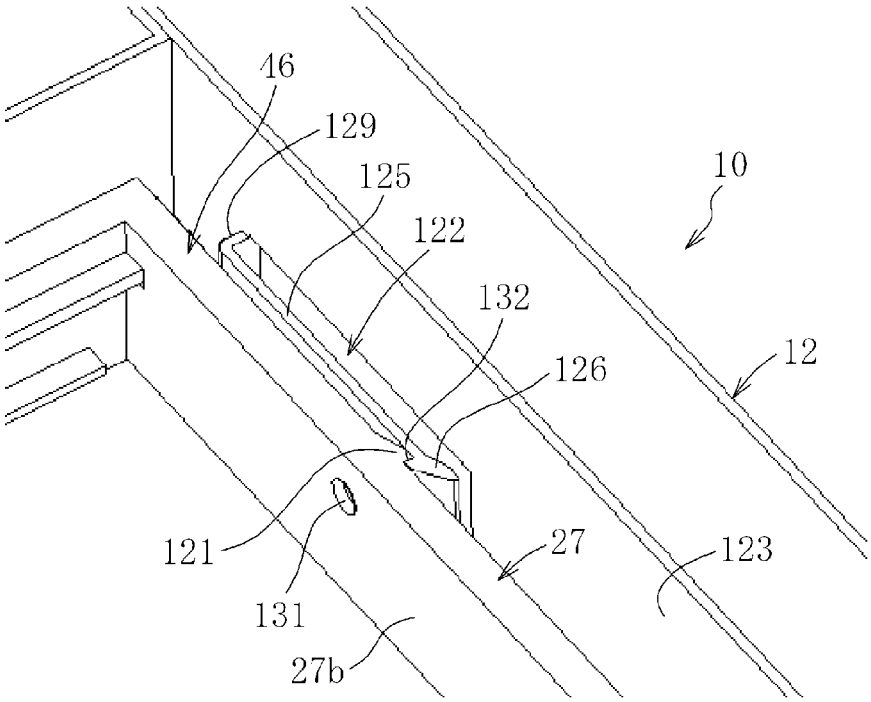
FIG. 16 is a perspective view illustrating the locking mechanism of FIG. 11 in a locked state.

If the pressure to the press tab 128 is released, the swing piece 125 becomes parallel to the rear frame 12 with respect to the frame 10 due to a restorative force of the locking claw 122. As a result, the locking claw 122 engages the locking portion 121, as illustrated in FIGS. 16 and 17. This state is referred to as an "engaged state". Specifically, the upper locking projection part 126A and the lower locking projection part 126B of the locking projection 126 of the locking claw 122 are latched (engaged) with the upper locking part 121A and the lower locking part 121B, respectively, thereby preventing the holder 46 from coming out from the frame 10.

As described above, the sheet supplying device 100 according to an embodiment of the present invention enables detachment and attachment of the recording media container 47 in two directions. With this configuration, the good operability of the recording media container 47 can be achieved in replacement of recording media and occurrence of the jam. Further, with this configuration, the sheet supplying device 100 can freely select the location of installation of the image forming apparatus 1. Furthermore, this configuration can achieve stable detachment and attachment of the recording media container 47 along the direction without providing a conventional mechanism for preventing a bottom plate. Therefore, the configuration of the image forming apparatus 1 can be simpler at lower costs.

By providing the holder 46 to hold the recording media container 47 by surrounding the outer circumference of the recording media container 47, the configuration of the frame 10, the configuration of the recording media container 47, and the configuration of the holder 46 can be made simpler, increasing productivity. Furthermore, the recording media container 47 can be moved in the two directions more stably and reliably. Specifically, in the movement of the recording media container 47 in the first detaching and attaching operation, the holder 46 remains attached to the frame 10 of the sheet supplying device 100. Therefore, only the recording media container 47 that is light in weight is moved, which can enhance the operability of detachment and attachment of the recording media container 47.

Since the sheet feeding unit 4 is integrally attached to the holder 46, the first detaching and attaching operation and the second detaching and attaching operation can be performed reliably, and the number of parts and components can be reduced for performing the operations.

By detaching and attaching the rotary shaft 75 of the sheet feeding unit 4 in the second direction, the rotary shaft 75 can be connected to or disconnected from the rotary drive force transmission unit 79. Therefore, even if the sheet feeding unit 4 is removed together with the recording media container 47 from the frame 10 in the second detaching and attaching operation, when the recording media container 47 is inserted to the frame 10 to be attached thereto again, the rotary shaft 75 can be connected to the rotary drive force transmission unit 79 reliably, thereby providing good operability of detachment and attachment of the recording media container 47.

Since the rotary shaft 75 of the sheet feeding unit 4 is pivotably supported at the upper portion of the holder 46 in the vicinity of the opening 28A, the rotary shaft 75 can be pivoted reliably, thereby conveying the recording medium reliably.

Since a sheet separation member, i.e., the separation pad 43 is fixed on the recording media container 47, the sheet supplying device 100 does not need to employ a conventional-type separation mechanism for separating the sheet feeding roller 42 of the sheet feeding unit 4 from the separation pad 43 that serves as a sheet separation member. This can reduce the number of components and parts used for the sheet supplying device 100 and simplify the configuration thereof, and therefore achieve cost reduction.

Further, the first exterior member 48A attached to the recording media container 47 can protect the front part (i.e., the front wall 66*a*) of the recording media container 47 when pulling the first exterior member 48A to detach the recording media container 47 from the frame 10 of the sheet supplying device 100, and enhance the rigidity of the recording media container 47 and further enhance the frame 10 and/or the holder 46 holding the recording media container 47 in the frame 10. Accordingly, even if the recording media container 47 is accommodated in the frame 10 or removed from the frame 10, the rigidity of the frame 10 can be maximized and the size of the sheet supplying device 100 can be minimized.

Further, the first exterior member 48A includes the handle 67 in the lower center portion thereof, and therefore the first detaching and attaching operation can be performed reliably, thereby achieving the speed-up of resupplying recording media in the sheet supplying device 100 and so forth.

Further, the container-side engaging member (i.e., the pin members 47*a*) engages the exterior-side engaging member (i.e., the engaging holes 48*a*) in response to movement of the recording media container 47 to be inserted into the frame 10 in the direction B2 in the second detaching and attaching operation. Therefore, the first detaching and attaching operation and the second detaching and attaching operation can be performed reliably with an uncomplicated configuration. Furthermore, the uncomplicated configuration that may induce a reduction in highly accurate fasting parts can achieve cost reduction.

Further, the second exterior member 48B attached to the holder 46 can enhance the rigidity of the holder 46 and further hold the recording media container 47 in a stable manner, which can stabilize the movement of the recording media container 47 in the second detaching and attaching operation.

Further, the second exterior member 48B includes the handle 55 on the lower center part thereof, and therefore the second detaching and attaching operation can be performed reliably, thereby achieving the speed-up of resupplying recording media in the sheet supplying device 100 and so forth.

Further, the container-side engaging member (i.e., the engaging holes 47*b*) engages the holder-side engaging member (i.e., the engaging pins 46*b*) in response to movement of the recording media container 47 to be inserted into the frame 10 in the direction B2 in the second detaching and attaching operation. Therefore, the first detaching and attaching operation and the second detaching and attaching operation can be performed reliably with an uncomplicated configuration, thereby enhancing the operability of detachment and attachment of the recording media container 47.

As previously described, the paper size indicator 200 includes the first indication part 101 and the second indication part 102, which enables the user to check the paper size from two different directions, thereby enhancing operability in reloading papers (recording media) in the recording media container 47 and transmitting a print job to the controller of the image forming apparatus 1. Specifically, as described in this embodiment, the first indication part 101 is visible for performing the first detaching and attaching operation and the second indication part 102 is visible for performing the second detaching and attaching operation. By employing the paper size indicator 200, errors in confirmation of the recording media loaded in the recording media container 47 can be prevented effectively both in the first detaching and attaching operation and the second detaching and attaching operation.

Since the paper size indicator 200 illustrated in FIGS. 10A and 10B includes one rotary drum (i.e., the rotary drum 105) disposed inside the front post 11, the first indication part 101 and the second indication part 102 are integrally mounted as a single unit. This can reduce the number of components and parts used for the sheet supplying device 100, and therefore reduce the weight of the sheet supplying device 100 and simplify the configuration thereof.

With the paper size indicator 200 disposed inside the front post 11, even in the first detaching and attaching operation or the second detaching and attaching operation, the paper size indicator 200 is configured to remain in the frame 10 when the recording media container 47 is removed from the frame 10. Therefore, no additional paper size indicator is required on the recording media container 47, thereby reducing the dimension and weight of the recording media container 47 and facilitating detachment of the recording media container 47.

In addition, the front post 11 is disposed at the corner of the frame 10 between the opening 28A used in the first detaching and attaching operation and the opening 28B used in the second detaching and attaching operation, thereby reliably performing confirmation of the size of the recording media both in the first detaching and attaching operation and the second detaching and attaching operation.

Further, since the first indication part 101 and the second indication part 102 are checked via the window 106 and the window 107, respectively, no parts of the paper size indicator 200 other than the size indicating part are exposed, and therefore damage to the paper size indicator 200 can be prevented, thereby providing a long service life. In addition, by forming the slope 108 widening toward the outer end of the through-hole of each of the windows 106 and 107, operability of rotation of the rotary drum 105 can be enhanced and the size of the recording medium can be easily checked from outside via the windows 106 and 107.

With the locking mechanism 120 as described above, the holder 46 and the frame 10 are locked in the state in which recording media container 47 is detached from the image forming apparatus 1 in the first detaching and attaching operation, and therefore the recording media container 47 cannot be pulled out in the second detaching and attaching operation. This configuration can prevent the user from pulling out or detaching the recording media container 47 by mistake or advertently in the second detaching and attaching operation. Further, when the user inserts or pushes the recording media container 47 in the first detaching and attaching operation, the holder 46 remains in the sheet supplying device 100, and therefore the recording media container 47 can be installed in the first detaching and attaching operation reliably. In other words, the sheet feeding device 100 requires a proper order of setting of the recording media container 47, in which the holder 46 needs to be set in the frame 10 before installing the recording media container 47 in the sheet feeding device 100. Therefore, since the holder 46 cannot be separated from the sheet feeding device 100 in the second detaching and attaching operation while the recording media container 47 is pulled out in the first detaching and attaching operation, the user can set the recording media container 47 according to the proper setting order, thereby providing the sheet feeding device 100 having good user operability.

The locking mechanism 120 allows the recording media container 47 to be detached from the frame 10 either in the first detaching and attaching operation or in the second detaching and attaching operation. Therefore, the recording media container 47 installed in the frame 10 can be withdrawn from the frame 10 in the first detaching and attaching operation or in the second detaching and attaching operation. That is, in the state in which the recording media container 47 is installed in the frame 10, the recording media container 47 can be removed from and then reinstalled to the frame 10 either in the first detaching and attaching operation or in the second detaching and attaching operation without the user operation of the locking mechanism 120, thereby further enhancing the user operability.

As previously described, the locking mechanism 120 includes the locking portion 121 and the locking claw 122, which can achieve an uncomplicated configuration of the locking mechanism 120, thereby achieving an uncomplicated configuration and enhancing assembling operability at low cost. Specifically, since the locking claw 122 may be provided integrally with the rear frame 12 of the frame 10 as a unit in the above-described embodiment, this configuration can achieve reductions in the number of components and parts used for the sheet supplying device 100, in the amount of resin used in the sheet supplying device 100, and in cost due to enhance of assembly operation, and accuracy in position of components and parts. By contrast, a complex configuration having a large number of the components and parts used in the sheet supplying device 100 can result in an increase in cost and a complex assembly operation.

[First Variation]

Next, referring to FIGS. 18 through 21, a description is given of a configuration of a locking mechanism 120A according to a first variation of the present invention.

The locking mechanism 120A according to the first variation includes a recessed portion 135 and a locking claw 136 that engages the recessed portion 135. The recessed portion 135 is mounted on an outer surface 124 of the rear wall 27*b* of the peripheral wall assembly 27 provided to the holder 46. The locking claw 136 corresponds to the locking claw 122 without the press tab 128.

Figure 20:
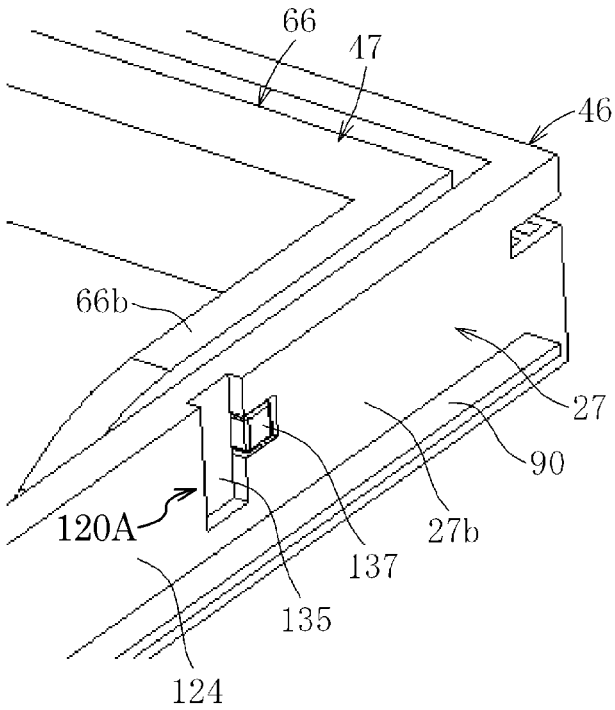
FIG. 20 is a perspective view illustrating a protruding portion of the locking mechanism of FIG. 18.
Figure 21:
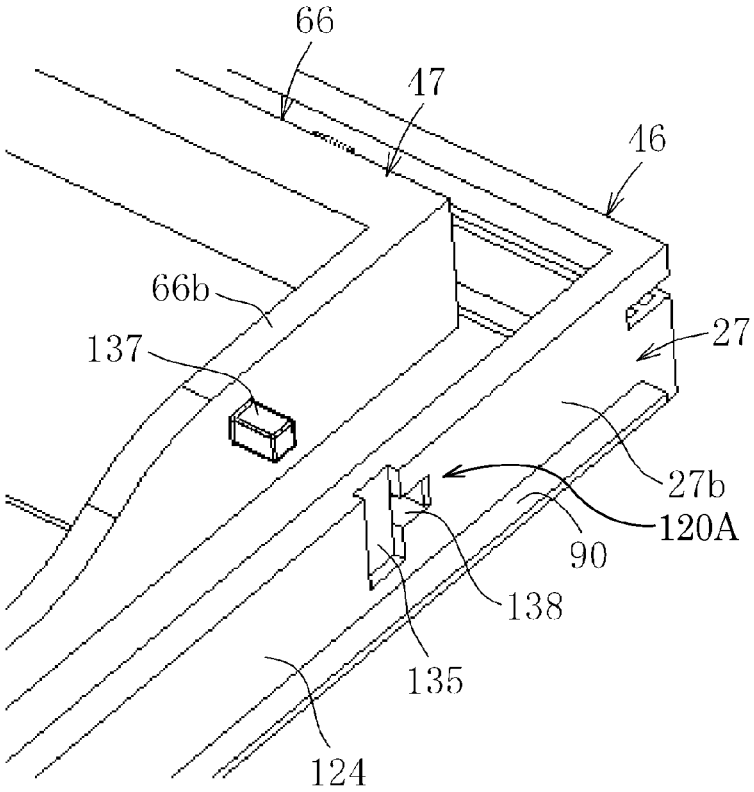
FIG. 21 is a perspective view of the locking mechanism of FIG. 18, in a state in which the recording media container is detached from the exterior member.

In this case, a pressure rod 137 presses the swing piece 125 of the locking claw 136 while the recording media container 47 is stored in the frame 10, and then the locking projection 126 of the locking claw 136 is not latched with the recessed portion 135. While the pressure rod 127 provided in the locking mechanism 120 according to the embodiment of the present invention has a cylindrical shape as illustrated in FIG. 15, the pressure rod 137 provided in the locking mechanism 120A according to the first variation is a quadrangular prism with a square cross section as illustrated in FIGS. 20 and 21. Therefore, a through-hole 138 provided on the rear wall 27*b* of the peripheral wall assembly 27 has a square shape.

Further, when the recording media container 47 is pulled out from the frame 10 in the first detaching and attaching operation, the swing piece 125 of the locking claw 136 is released from the mechanical pressure exerted by the pressure rod 12, the locking claw 136 swings or rotates toward the rear wall 27*b* of the peripheral wall assembly 27 of the holder 46, and the locking projection 126 of the locking claw 136 latches (engages) the recessed portion 135. According to this configuration, the swing piece 125 swings or rotates about the vertical piece 129 in directions indicated by arrows C1 and C2 in FIG. 12.

Accordingly, the locking mechanism 120A illustrated in FIGS. 18 through 21 can achieve the same effect as the locking mechanism 120 illustrated in FIGS. 11 and 17. Specifically, by including the recessed portion 135 and the locking claw 136 in the locking mechanism 120A, when the holder 46 is detached from the sheet supplying device 100, any members included in the locking mechanism 120A does not protrude outwardly from the holder 46, thereby effectively preventing damage to the members included in the locking mechanism 120A.

[Second Variation]

Figure 22:
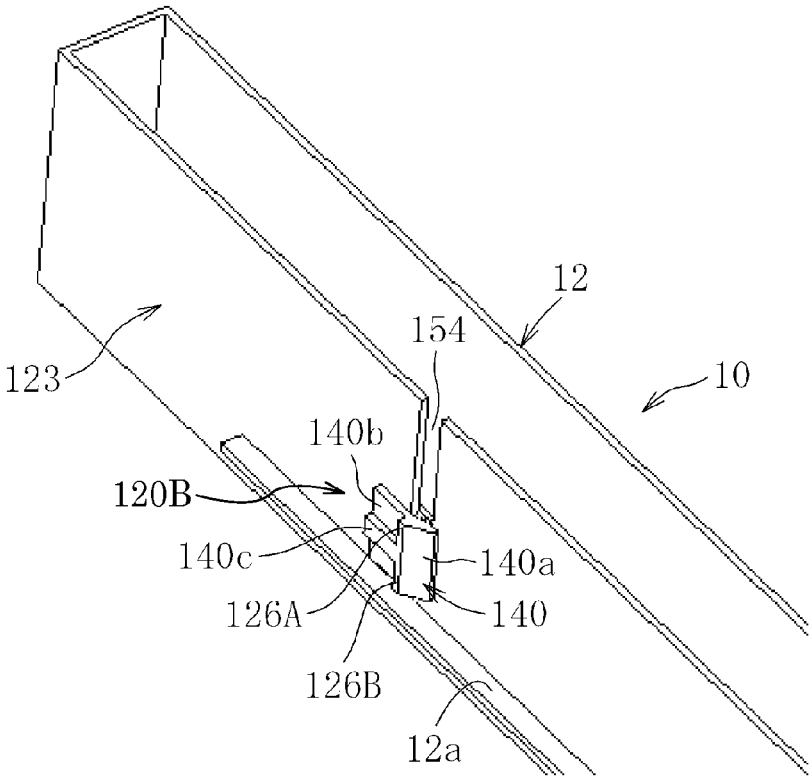
FIG. 22 is a perspective view illustrating a configuration of a locking mechanism according to a second variation.
Figure 23:
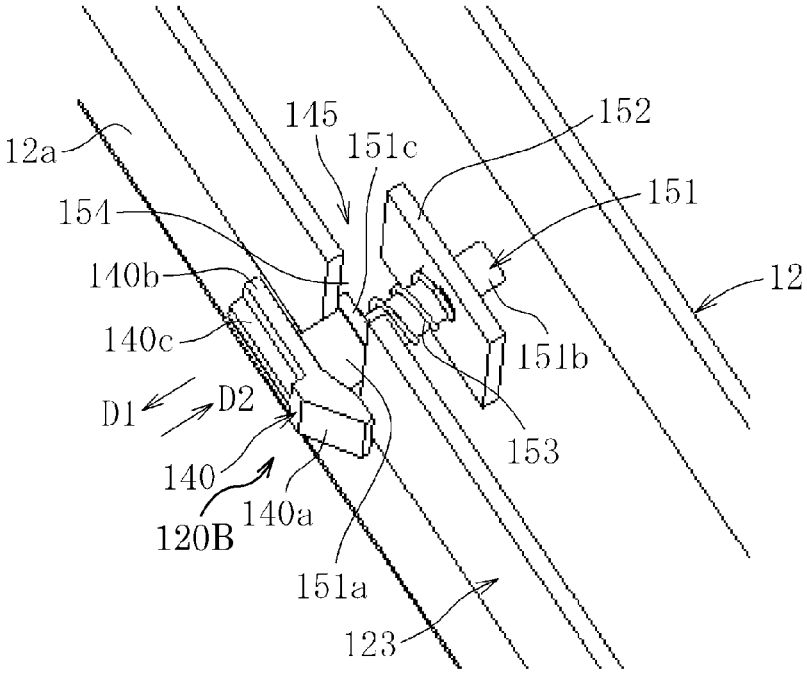
FIG. 23 is a perspective view illustrating movement of the locking mechanism of FIG. 22.

Next, referring to FIGS. 22 and 23, a description is given of a configuration of a locking mechanism 120B according to a second variation.

The elements or components of the locking mechanism 120B according to the second variation are similar in structure and function to those of the locking mechanism 120 according to an embodiment of the present invention and the locking mechanism 120A according to the first variation, except that the locking mechanism 120B according to the second variation further includes a locking claw 140 that is provided separately from the rear frame 12 of the frame 10 while the locking claw 122 of the locking mechanism 120 according to an embodiment of the present invention and the locking claw 136 of the locking mechanism 120A according to the first variation are integrally provided with the rear frame 12 of the frame 10.

The locking claw 140 has a similar shape and function to the leading edge of the swing piece 125 of the locking mechanism 120 as illustrated in FIG. 11. Specifically, the locking claw 140 includes a head 140*a* and a base plate 140*b* that is connected to the head 140*a*. A press tab 140*c* is mounted on the base plate 140*b*. The pressure rod 127 presses the press tab 140*c*. The head 140*a* includes the upper locking projection part 126A and the lower locking projection part 126B.

In the second variation, the locking claw 140 is pressed by a biasing unit 145 elastically in a direction indicated by arrow D1 as illustrated in FIG. 23.

The biasing unit 145 includes a supporting rod 151, a receiving member 152, and an elastic member 153. The supporting rod 151 supports the locking claw 140 from the opposite side of the inner wall 123 of the rear frame 12. The receiving member 152 is provided to the rear frame 12 of the frame 10 to support the supporting rod 151. The elastic member 153 (e.g., a coil spring) is fit onto the supporting rod 151 disposed between the inner wall 123 of the rear frame 12 and the receiving member 152 to press the supporting rod 151 in the direction D1.

The supporting rod 151 includes a boss 151*a* and a rod part 151*b*. The boss 151*a* is disposed on the side of the locking claw 140. The rod part 151*b* extends from the boss 151*a* in an opposed direction from the locking claw 140. A guard 151*c* is provided between the boss 151*a* and the rod part 151*b*. In the configuration of the second variation, the elastic member 153 is interposed between the guard 151*c* and the receiving member 152. Further, the rod part 151*b* is inserted into a through-hole in the receiving member 152 and is movable reciprocally along an axial direction thereof. With this configuration, the supporting rod 151 is pressed in the direction D1, which causes the guard 151*c* to contact the inner wall 123. Therefore, as illustrated in FIG. 23, the locking claw 140 projects from the inner wall 123 via an opening 154 in the inner wall 123 of the rear frame 140.

In the state as illustrated in FIG. 23, the recording media container 47 can be stored in the frame 10 having the holder 46 therein by performing the first detaching and attaching operation. By storing the recording media container 47 in the frame 10, the locking claw 140 is pressed by the pressure rod 127 via the press tab 140*c* in a direction indicated by arrow D2. With this action, the locking claw 140 moves toward the inner wall 123.

As a result, in the state as illustrated in FIG. 23, the upper locking projection part 126A and the lower locking projection part 126B of the head 140*a* of the locking claw 140 engage the locking portion 121 that is provided to the outer surface 124 of the rear wall 27*b* included in the peripheral wall assembly 27 of the holder 46, thereby restricting and preventing the holder 46 from detaching from the frame 10. Further, when the recording media container 47 is stored in the frame 10 by performing the first detaching and attaching operation, the locking claw 140 moves toward the inner wall 123, as described above, thereby disengaging the head 140*a* of the locking claw 140 from the locking portion 121. This action allows the detachment of the recording media container 47 by performing the first detaching and attaching operation and the second detaching and attaching operation.

Accordingly, the locking mechanism 120B illustrated in FIGS. 22 and 23 can achieve the same effect as the locking mechanism 120 illustrated in FIGS. 11 through 17.

It is to be noted that, since it is likely to cause abrasion and/or noise due to detaching and attaching operations of the recording media container 47 in a sliding manner, the members and parts used for engagement of the locking mechanisms 120, 120A, and 120B preferably have good slidability. Further, when the locking claw 122 as illustrated in FIG. 11 is integrally included, these members and parts may need to be elastic. Therefore, to construct these members and/or parts integrally with the locking claw 122, both slidability and elasticity are required, which makes it difficult to select appropriate materials.

By contrast, if the locking claw 122 is installed separately, the members and/or parts of which slidability is required need to be slidable and only the members and/or parts of which elasticity is required need to be elastic. By so doing, the locking mechanisms 120, 120A, and 120B can achieve good operability.

[Third Variation]

Figure 24:
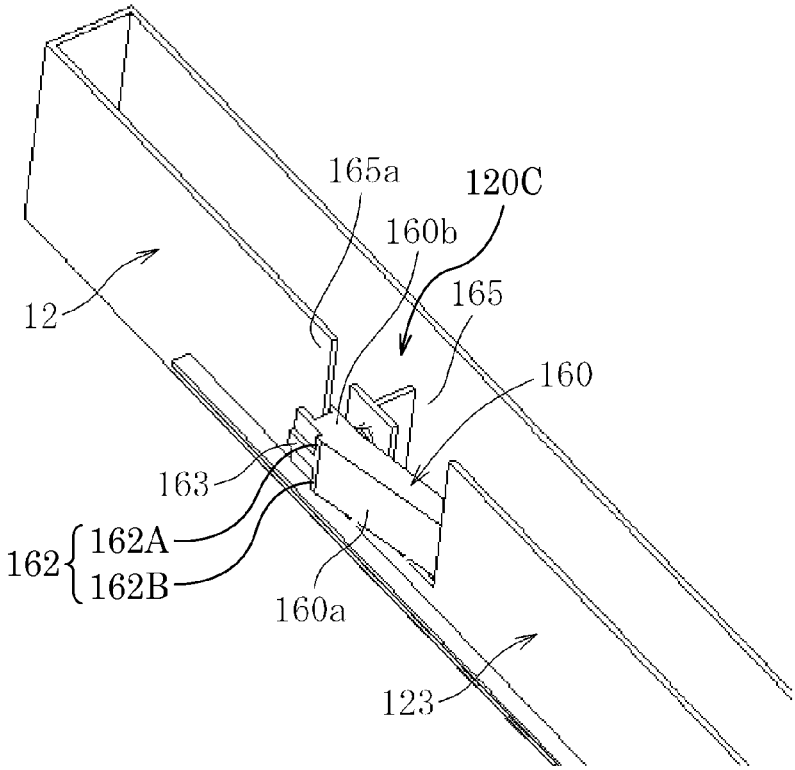
FIG. 24 is a perspective view illustrating a configuration of a locking mechanism according to a third variation 3.
Figure 25:
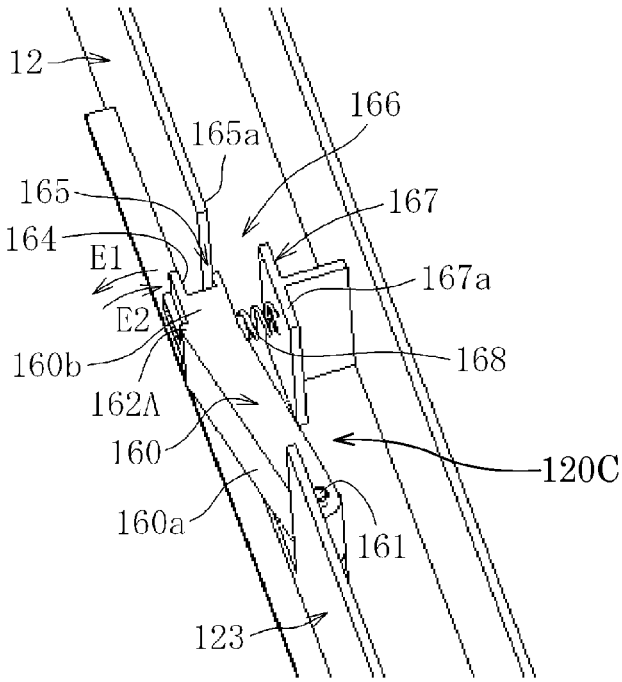
FIG. 25 is a perspective view illustrating movement of the locking mechanism of FIG. 24.

Next, referring to FIGS. 24 and 25, a description is given of a configuration of a locking mechanism 120C according to a third variation.

The locking mechanism 120C as illustrated in FIGS. 24 and 25 includes a locking claw 160 that rotates about a base end pivot 161 in directions indicated by arrows E1 and E2. The locking claw 160 includes a claw body 160*a* and a head 160*b*. The claw body 160*a* is an arm-shaped member extending from the base end pivot 161. The head 160*b* is mounted on a distal end of the claw body 160*a*, which is an opposite end of the base end pivot 161.

The locking claw 160 is further provided with a locking projection 162 and a press tab 163. The locking projection 162 includes an upper locking projection part 162A and a lower locking projection part 162B at one end part on an outer circumference of the head 160*b*. An opening 164 is formed in a leading end surface of the head 160*b*. Further, an opening 165 is formed in the inner wall 123 of the rear frame 12 so that the locking claw 160 is disposed inside the opening 165. The opening 165 includes a cutout end 165*a* formed at one side thereof (i.e., at a distal end thereof for the second detaching and attaching operation) so that the cutout end 165*a* freely fits the opening 164 of the locking claw 160.

The locking claw 160 is pressed by a biasing unit 166 elastically in a direction indicated by arrow E1 as illustrated in FIG. 25. The biasing unit 166 includes a receiving member 167, and an elastic member 168. The receiving member 167 is provided to the rear frame 12 of the frame 10. The receiving member 167 includes a receiving plate 167*a*. The elastic member 168 is disposed between the receiving plate 167*a* of the receiving member 167 and the head 160*b* of the locking claw 160. With this configuration, the head 160*b* of the locking claw 160 is pressed in the direction E1 by an elastic force generated by the elastic member 168, which causes an inside surface of the elastic member of the opening 165 to contact the cutout end 165*a*. Therefore, as illustrated in FIG. 25, the locking projection 162 projects toward the holder 46.

Further, in this state, the recording media container 47 can be stored in the frame 10 having the holder 46 therein by performing the first detaching and attaching operation. By storing the recording media container 47 in the frame 10, the locking claw 160 is pressed by the pressure rod 127 or 137 via the press tab 163 in a direction indicated by arrow E2. With this action, the locking claw 160 moves toward the inner wall 123.

Therefore, in a state as illustrated in FIG. 25, the locking claw 160 engages the locking portion 121 mounted on the outer surface 124 of the rear wall 27*b* that is included in the peripheral wall assembly 27 of the holder 46 to restrict an unexpected removal of the holder 46 from the frame 10. Further, in a state in which the recording media container 47 is installed in the frame during the first detaching and attaching operation, the locking claw 160 retreats toward the inner wall 123, thereby disengaging the head 160*b* of the locking claw 160 from the locking portion 121. This enables the removal of the recording media container 47 from the frame 10 during the first detaching and attaching operation and the second detaching and attaching operation.

Accordingly, the locking mechanism 120C illustrated in FIGS. 24 and 25 can achieve the same effect as the locking mechanism 120B illustrated in FIGS. 22 and 23. Specifically, by including the locking claw 160 to swing or rotate about the base end pivot 161, detachment and attachment of the locking mechanism 120C can be smoothly performed.

As described above, the configuration of the third variation can reduce the force needed to control the locking claw 160 that is swingable or rotatable about the base end pivot 161, thereby enhancing durability of the locking claw 160.

Further, in the locking mechanism 120C as illustrated in FIGS. 24 and 25, the locking claw 160 is disposed intruding to the holder 46, which exerts a large locking force and therefore can reduce a biasing force of the elastic member 168 that biases the locking claw 160, thereby further reducing the control force and durability of the locking mechanism 120C.

By contrast, as illustrated in FIGS. 22 and 23, the locking claw 140 moves parallel to the holder 46. In this case, it is likely to cause abrasion and/or noise due to slidable movements of the locking claw 140 along the holder 46. Further, if the locking claw 140 does not move in parallel accurately, an excess control force can be exerted in detachment and attachment of the holder 46 and/or the holder 46 can be caught or stuck in the frame 10, likely damaging the locking mechanism 120 and/or the frame 10.

Obviously, with the sheet supplying device 100 with the above-described configuration, the image forming apparatus 1 can provide good operability of the recording media container 47 and good access to the recording container 47 of the sheet supplying device 100 in two different directions at low cost. Therefore, the image forming apparatus is applicable to various types of image forming apparatuses such as a printer, copier, facsimile machine, printing machine, inkjet printer and so forth, incorporating the sheet supplying device.

The configuration of the present invention is not limited thereto but can be modified without departing from the scope or spirit of the present invention.

In the above-described embodiment and variations of the present invention, the exterior side engaging member corresponds to the multiple engaging holes 48*a* as illustrated in FIG. 4 and the container side engaging member corresponds to the multiple pin members 47*a* as illustrated in FIG. 5. However, the exterior side engaging member can include multiple pin members and the container side engaging member can include multiple engaging holes.

Further, in the above-described embodiment and variations of the present invention, the holder side locking member corresponds to the multiple engaging pin members 46*b* as illustrated in FIG. 6 and the container side locking member corresponds to the multiple engaging holes 47*b* as illustrated in FIG. 7. However, the holder side locking member can include multiple engaging holes and the container side locking member can include multiple engaging pin members.

As described in the embodiment, one pair of pin members 47*a* is disposed on the side wall 66*c* of the recording media container 47 in the vicinity of one end of the front wall 66*a* and another pair of pin members 47*a* is disposed on a projecting piece 68 that projects from the side wall 66*d* in the vicinity of the other end of the front wall 66*a* of the recording media container 47. That is, these two pairs of pin members 47*a* are disposed separate from each other in a direction perpendicular to the sheet conveyance direction. This layout can effectively prevent the pin members 47*a* from playing or rattling. Therefore, as long as the pin members do not play or rattle, the pin members 47*a* can be located at any other position of the recording media container 47. More specifically, it is important that the first exterior member 48A and the recording media container 47 do not separate from each other in the first detaching and attaching operation, the first exterior member 48A remains installed in the frame 10 in detachment of the recording media container 47 in the second detaching and attaching operation, and the first exterior member 48A and the recording media container 47 are connected to each other in attachment of the recording media container 47 in the second detaching and attaching operation.

In the above-described embodiment, the recording media container 47 can be removed from the frame 10 during the first detaching and attaching operation toward a downstream direction in the sheet conveyance direction. However, the direction of removal of the recording media container 47 during the first detaching and attaching operation is not limited thereto. For example, the recording media container 47 can be removed to an upstream direction in the sheet conveyance direction.

Further, the possible type of recording media used in the sheet supplying device 100 according to the present invention include standard sheets used for printing, 90K-type sheets (i.e., a batch of 1000 sheets weighting approximately 90 kg) such as OHP sheets, cards, and postcards, thick papers having a paper weight of sheet about 100 g/m$^2$ or greater, and special sheets with higher heat capacity than envelope and so forth.

The locking mechanism 120 illustrated in FIGS. 11 through 17 employs the pressure rod 127 having a cylindrical shape and the locking mechanism 120 illustrated in FIGS. 20 and 21 employs the pressure rod 137 having a quadrangular prism shape. However, the locking mechanism 120 of FIGS. 11 through 17 may use the quadrangular-prism-shaped pressure rod 137 and the locking mechanism 120 of FIGS. 20 and 21 may use the cylindrical-shaped pressure rod 127. Further, the elastic members 153 and 168 used in the locking mechanism 120 are applicable not only to coil springs but also other elastic members.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A sheet supplying device comprising:

a recording media container to accommodate a stack of recording media therein;

a sheet feeding unit to feed a recording medium from the stack of recording media in the recording media container;

a frame to support the recording media container and the sheet feeding unit;

a holder to hold the recording media container by surrounding the outer circumference of the recording media container; and a locking mechanism to engage the frame and the holder with each other, wherein:

the recording media container is detachably attachable to the frame in:

a first detaching and attaching operation in which the recording media container is inserted into or removed from the frame in a direction parallel to a sheet conveyance direction in which the recording medium is fed and conveyed upstream or downstream by the sheet feeding unit, and the recording media container is separated from the frame and the holder with the holder remaining in the frame; and a second detaching and attaching operation in which the recording media container is inserted into or removed from the frame in a direction perpendicular to the sheet conveyance direction, and the recording media container is separated from the frame together with the holder, the locking mechanism causes the frame and the holder to engage at removing the recording media container in the first detaching and attaching operation, the locking mechanism includes a locking portion and a locking claw, the locking claw is engaged with the locking portion in a state in which the recording media container is separated from the frame during the first detaching and attaching operation, the locking claw is disengaged from the locking portion in a state in which the recording media container is installed in the frame, the locking claw of the locking mechanism is mounted apart from the frame, and the locking claw is configured to swing between a locked state and an unlocked state.

2. The sheet feeding device according to claim 1, wherein, in response to the unlock of the locking mechanism, the recording media container installed in the frame is removed from the frame during one of the first detaching and attaching operation and the second detaching and attaching operation.

3. The sheet feeding device according to claim 1, wherein the locking claw of the locking mechanism is mounted together with the frame.

4. The sheet feeding device according to claim 1, wherein the locking claw of the locking mechanism is mounted apart from the frame, wherein the locking claw is configured to slide between a locked state and an unlocked state.

5. An image forming apparatus comprising the sheet supplying device according to claim 1.

6. An image forming apparatus comprising:

the sheet supplying device according to claim 5;

an image forming device to form an image on the recording medium fed from the sheet feeding device; and a sheet discharging device to discharge the recording medium with the image formed thereon.

7. A sheet supplying device comprising:

a recording media container to accommodate a stack of recording media therein;

a sheet feeding unit to feed a recording medium from the stack of recording media in the recording media container;

a frame to support the recording media container and the sheet feeding unit;

a holder to hold the recording media container by surrounding the outer circumference of the recording media container; and a locking mechanism to engage the frame and the holder with each other, wherein:

the recording media container is detachably attachable to the frame in:

a first detaching and attaching operation in which the recording media container is inserted into or removed from the frame in a direction parallel to a sheet conveyance direction in which the recording medium is fed and conveyed upstream or downstream by the sheet feeding unit, and the recording media container is separated from the frame and the holder with the holder remaining in the frame; and a second detaching and attaching operation in which the recording media container is inserted into or removed from the frame in a direction perpendicular to the sheet conveyance direction, and the recording media container is separated from the frame together with the holder, the locking mechanism causes the frame and the holder to engage at removing the recording media container in the first detaching and attaching operation, the locking mechanism includes a recessed portion and a locking claw, the locking claw is engaged with the recessed portion in a state in which the recording media container is separated from the frame during the first detaching and attaching operation, the locking claw is disengaged from the recessed portion in a state in which the recording media container is installed in the frame, the locking claw of the locking mechanism is mounted apart from the frame, and the locking claw is configured to swing between a locked state and an unlocked state.

8. The sheet feeding device according to claim 7, wherein the locking claw of the locking mechanism is mounted together with the frame.

9. The sheet feeding device according to claim 7, wherein the locking claw of the locking mechanism is mounted apart from the frame, wherein the locking claw is configured to slide between a locked state and an unlocked state.

10. An image forming apparatus comprising the sheet supplying device according to claim 7.

11. An image forming apparatus comprising:

the sheet supplying device according to claim 10;

an image forming device to form an image on the recording medium fed from the sheet feeding device; and a sheet discharging device to discharge the recording medium with the image formed thereon.

* * * * *

UNITED STATES PATENT AND TRADEMARK OFFICE

CERTIFICATE OF CORRECTION

PATENT NO. : 8,684,348 B2
APPLICATION NO. : 13/738370
DATED : April 1, 2014
INVENTOR(S) : Yasuo Matsuyama It is certified that error appears in the above-identified patent and that said Letters Patent is hereby corrected as shown below:

On the Title Page: Item (30) should read:

(30) Foreign Application Priority Data

Jan. 23, 2012 (JP) ..... 2012-010860

Signed and Sealed this
Twenty-second Day of July, 2014

Michelle K. Lee

Michelle K. Lee
*Deputy Director of the United States Patent and Trademark Office*